US006331003B1

(12) United States Patent
Yokota et al.

(10) Patent No.: US 6,331,003 B1
(45) Date of Patent: Dec. 18, 2001

(54) RECORDING MEDIUM DISCHARGING APPARATUS AND IMAGE FORMING APPARATUS PROVIDED THEREWITH

(75) Inventors: Eiji Yokota; Atsuo Hirose; Kazuhiko Takagi; Hiroyuki Kashima; Kazumasa Makino, all of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/385,035

(22) Filed: Aug. 30, 1999

Related U.S. Application Data

(63) Continuation-in-part of application No. 09/253,551, filed on Feb. 22, 1999, which is a continuation-in-part of application No. 09/236,466, filed on Jan. 25, 1999.

(30) Foreign Application Priority Data

| | | |
|---|---|---|
| Jan. 27, 1998 | (JP) | 10-013686 |
| Feb. 16, 1998 | (JP) | 10-032471 |
| Feb. 23, 1998 | (JP) | 10-040213 |
| Mar. 18, 1999 | (JP) | 11-073511 |
| Mar. 18, 1999 | (JP) | 11-073512 |
| Mar. 18, 1999 | (JP) | 11-073513 |

(51) Int. Cl.[7] ..... B65H 31/24

(52) U.S. Cl. ..... 271/290; 271/298; 271/305; 271/287

(58) Field of Search ..... 271/279, 287–290, 271/298, 303, 305

(56) References Cited

U.S. PATENT DOCUMENTS

| | | | |
|---|---|---|---|
| 4,227,683 | 10/1980 | Spangler et al. . | |
| 4,501,419 | 2/1985 | Takahashi et al. . | |
| 4,520,263 | 5/1985 | Kitamura . | |
| 5,141,222 | 8/1992 | Sawada et al. . | |
| 5,319,216 | 6/1994 | Mokuo et al. . | |
| 5,328,169 | 7/1994 | Mandel . | |
| 5,505,442 * | 4/1996 | Chang et al. | 271/298 |
| 5,551,686 | 9/1996 | Sanchez et al. . | |
| 5,630,578 * | 5/1997 | Naramore et al. | 271/298 |
| 5,632,479 * | 5/1997 | Kubota et al. | 271/298 |
| 5,810,353 | 9/1998 | Baskette et al. . | |
| 5,963,754 | 10/1999 | Itoh et al. . | |
| 5,971,384 * | 10/1999 | Asao | 270/58.13 |
| 6,142,469 * | 11/2000 | Nanbe et al. | 271/298 |

FOREIGN PATENT DOCUMENTS

| | | |
|---|---|---|
| 0 757 964 A2 | 12/1997 | (EP) . |
| 1-197277 | 8/1989 | (JP) . |
| A-9-175714 | 7/1997 | (JP) . |

* cited by examiner

*Primary Examiner*—Christopher P. Ellis
*Assistant Examiner*—Mark A. Deuble
(74) *Attorney, Agent, or Firm*—Oliff & Berridge, PLC

(57) ABSTRACT

A recording medium discharging apparatus which can be mounted on top of the image forming apparatus includes a plurality of recording medium storers and a locking mechanism for locking the discharging apparatus to the image forming apparatus when the discharging apparatus is mounted on the image forming apparatus. The locking mechanism includes a release lever for unlocking the discharging apparatus by being manipulated to shift in the same direction as the discharging apparatus moves away from the image forming apparatus to be dismounted from it. The locking mechanism prevents the discharging apparatus from falling off the image forming apparatus even if external force is applied to the discharging apparatus mounted on the image forming apparatus. The release lever for unlocking the discharging apparatus makes it easy to dismount the discharging apparatus from the image forming apparatus.

30 Claims, 14 Drawing Sheets

FIG. 13A
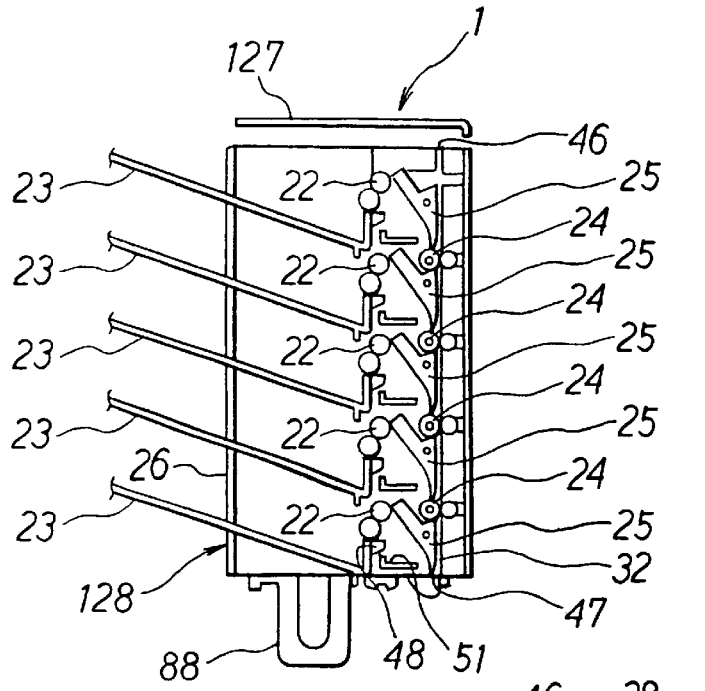
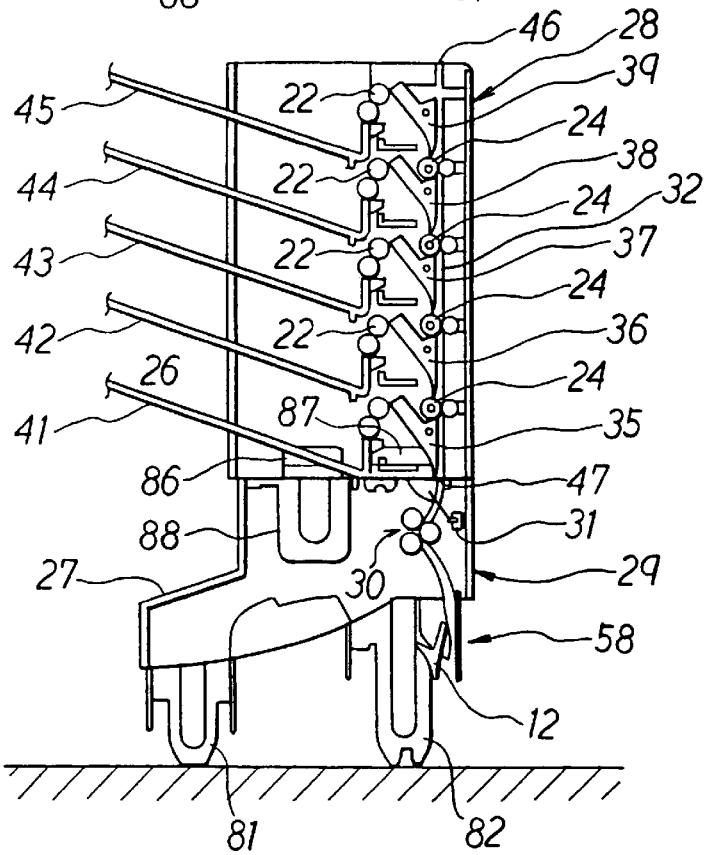
FIG. 13B

RECORDING MEDIUM DISCHARGING APPARATUS AND IMAGE FORMING APPARATUS PROVIDED THEREWITH

This application is a continuation in part of U.S. patent application Ser. No. 09/253,551 filed on Feb. 22, 1999, which in-turn is a Continuation-in-Part of application Ser. No. 09/236,466 filed Jan. 25, 1999 and priority-based on Japanese patent applications No. 10-13686, No. 10-32471 and No. 10-40213.

BACKGROUND OF THE INVENTION

1. Field of the Invention

The present invention relates to a recording medium discharging apparatus and an image forming apparatus provided with the discharging apparatus. In particular, the invention relates to a recording medium discharging apparatus which can be mounted on top of an image forming apparatus such as a printer in order to receive, sort and store recording media on which images have been formed.

2. Description of Related Art

Conventionally known is a recording medium processor apparatus for receiving, sorting and storing or holding recording media such as sheets of paper on which images have been formed by an image forming machine such as a copying machine, a printer and a facsimile machine. A recording medium processor of this type is provided generally as an option for an image forming apparatus, and is sometimes called as "discharging apparatus", "sorter", "mail box" etc. The recording medium processor can be mounted detachably on top of the image forming apparatus so that a space over the image forming apparatus can be utilized for space saving.

The recording medium processor has an inlet formed at its bottom, through which recording media can enter it. The processor also has two legs protruding downward from its bottom each on one side. The image forming apparatus has an outlet formed at its top for discharging through it the recording media on which images have been formed. The image forming apparatus also has two slots formed at its top for receiving the respective legs. The processor can be mounted on top of the image forming apparatus with the legs inserted from above into the respective slots, and with the inlet and the outlet connected together.

The image forming apparatus originally includes a tray for storing or holding sheets of paper on which images have been formed by the image forming apparatus. When the recording medium processor is not mounted on the image forming apparatus, all the sheets are discharged to the tray. When the processor is mounted on the image forming apparatus, all or some of the sheets may be conveyed from the image forming apparatus to the processor. The image forming apparatus also includes a pivotable flapper for switching the conveyance of sheets to either the image forming apparatus tray or the processor inlet.

Because the flapper is required only when the recording medium processor is mounted on the image forming apparatus, the provision of the flapper may lead to a wasteful cost increase for the image forming apparatus itself (the first problem).

After dismounting the recording medium processor from the image forming apparatus, it is not possible to place the processor on only the two legs stably on a floor or the like. If the dismounted processor is placed on the legs, it may fall down and consequently be damaged. Therefore, the dismounted processor needs to be laid down on a floor, leaned against a wall or supported by a member. It is thus troublesome to dismount the processor from the image forming apparatus, keep the dismounted processor from damage, and mount the dismounted processor again on the image forming apparatus (the second problem).

The recording medium processor is mounted on the image forming apparatus simply with its legs inserted into the respective slots of the image forming apparatus. If external force is applied to the thus mounted processor, the processor may tilt and consequently result in defective operation. Even greater external force may cause the mounted processor to fall from the image forming apparatus and consequently be damaged (the third problem).

The recording medium processor might be screwed or bolted to the image forming apparatus. This would, however, be troublesome and/or time-consuming, and therefore prevent the processor from being mounted on and dismounted from the image forming apparatus simply or easily.

SUMMARY OF THE INVENTION

It is accordingly an object of the present invention to provide a recording medium discharging apparatus and the image forming apparatus which can prevent wasteful cost increase for the image forming apparatus.

It is another object of the invention to provide a recording medium discharging apparatus which can be placed stably on a floor or the like even after dismounted from an image forming apparatus, and which is easy to mount on and dismount from the image forming apparatus.

It is still another object of the invention to provide a recording medium discharging apparatus which can be held securely or reliably on an image forming apparatus, and which is simple or easy to mount on and dismount from the image forming apparatus.

In accordance with a first aspect of the invention, an image forming machine is provided, which includes an image forming apparatus for forming images on recording media. The apparatus also includes a recording medium discharging apparatus which can be mounted on top of the image forming apparatus, the discharging apparatus including a plurality of recording medium storers. The apparatus further includes a locking mechanism for locking the discharging apparatus to the image forming apparatus when the discharging apparatus is mounted on the image forming apparatus. The locking mechanism includes a release lever for unlocking the discharging apparatus by being manipulated to shift in the same direction as the discharging apparatus moves away from the image forming apparatus to be dismounted from it.

As stated above, the image forming apparatus includes a locking mechanism for locking the recording medium discharging apparatus to the image forming apparatus when the discharging apparatus is mounted on the image forming apparatus. The locking mechanism prevents the discharging apparatus from falling off the image forming apparatus even if external force is applied to the discharging apparatus mounted on the image forming apparatus. The release lever for unlocking the discharging apparatus makes it easy to dismount the discharging apparatus from the image forming apparatus. This lever can be manipulated to shift in the same direction as the discharging apparatus moves away from the image forming apparatus to be dismounted from it. This makes it possible to drive the lever by utilizing the force applied by a user to dismount the discharging apparatus from the image forming apparatus. It is therefore possible to unlock the discharging apparatus by the operation of dismounting the discharging apparatus from the image forming apparatus.

The recording medium discharging apparatus may include a holding portion which can be held by a user's hand. In particular, by supporting the release lever on the holding portion, it is possible for a user to manipulate the lever while holding the holding portion to dismount the discharging apparatus from the image forming apparatus. The lever may be urged to protrude from the holding portion. In this case, when the user lifts the discharging apparatus from the image forming apparatus, his or her hand draws the lever until the lever retracts into the holding portion against the urging force.

The locking mechanism may include a locking member provided at one of the image forming apparatus and the recording medium discharging apparatus, and shiftable between a locking position and an unlocking position. This mechanism may also include an engaging portion provided at the other of the image forming apparatus and the discharging apparatus. When in the locking position, the locking member is in engagement with the engaging portion. In this case, the release lever moves to shift the locking member from the locking position to the unlocking position.

The recording medium discharging apparatus may include a pair of connectors provided on both sides thereof and extending toward the image forming apparatus. The image forming apparatus may include a pair of engaging portions for receiving the respective connectors. The holding portion may be formed substantially at the midpoint between the connectors. In this case, when a user lifts the discharging apparatus, its weight is balanced with respect to the holding portion. This enables the discharging apparatus to be dismounted safely.

In accordance with a second aspect of the invention, a recording medium discharging apparatus is provided, which can be mounted on top of an image forming apparatus for forming images on recording media. This discharging apparatus includes a plurality of recording medium storers. The discharging apparatus also includes a locking mechanism for locking the discharging apparatus to the image forming apparatus when the discharging apparatus is mounted on the image forming apparatus. The locking mechanism includes a release lever for unlocking the discharging apparatus by being manipulated to shift in the same direction as the discharging apparatus moves away from the image forming apparatus to be dismounted from the image forming apparatus.

This recording medium discharging apparatus can be mounted on an image forming apparatus according to the first aspect, and may further include:

- a recording medium introducing section for introducing the recording media with images formed thereon by the image forming apparatus;
- a conveying device for conveying the media introduced into the introducing section;
- a plurality of discharging devices for discharging to the respective recording medium storers the media conveyed from the conveying device; and
- a switching device for guiding selectively to any of the discharging devices the media conveyed by the conveying device.

In accordance with a third aspect of the invention, another recording medium discharging apparatus is provided, which can be mounted on top of an image forming apparatus. This discharging apparatus includes a body including a recording medium storer. The discharging apparatus also includes at least three extensions extending downward from the body for mounting the body with them on the image forming apparatus. The bottoms of the extensions support the discharging apparatus on a horizontal plane when the discharging apparatus is dismounted from the image forming apparatus.

The extensions, with which the discharging apparatus body can be mounted on the image forming apparatus, function as supports for the discharging apparatus. Therefore, when dismounted from the image forming apparatus, the discharging apparatus can stand on the bottoms of the extensions stably on a floor. This prevents the discharging apparatus from being damaged by falling down.

The extensions may be two pairs of extensions, and each pair of them may extend downward from the discharging apparatus body on one side of the discharging apparatus. The four extensions can support the discharging apparatus more stably on a floor. In order to make the discharging apparatus more stable, it is preferable that the center of gravity of the discharging apparatus be positioned between two vertical planes each extending through one of the extensions of one pair and the adjacent extension of the other pair. It is more preferable that the center be positioned substantially at the midpoint between the planes. The image forming apparatus may include four engaging portions for receiving the respective extensions.

The discharging apparatus body may include a recording medium receiver which can be mounted on the image forming apparatus for receiving recording media from the image forming apparatus. The recording medium storer may be mounted on the receiver. The recording medium discharging apparatus may include a pair of connectors for mounting the storer with them on the receiver. The connectors may be fitted to either of the storer and the receiver. Each of the connectors may be positioned between the extensions of one pair.

The recording medium storer may include a plurality of bins. The recording medium discharging apparatus may include a conveying device for conveying the recording media received by the recording medium receiver. The discharging apparatus may also include a plurality of discharging devices for discharging to the respective bins the media conveyed from the conveying device. The discharging apparatus may further include a switching device for guiding selectively to any of the discharging devices the media conveyed by the conveying device.

In accordance with a fourth aspect of the invention, still another recording medium discharging apparatus is provided, which can be mounted on top of an image forming apparatus for forming images on recording media. This forming apparatus includes a discharging portion for discharging the media with images formed thereon. This discharging apparatus includes a plurality of recording medium storers. The discharging apparatus also includes a recording medium introducing section for introducing the media from the image forming apparatus into the discharging apparatus when the discharging apparatus is mounted on the image forming apparatus. The discharging apparatus further includes a switching device for guiding selectively to either of the discharging portion of the image forming apparatus and the introducing section the media with images formed thereon.

As stated above, this recording medium discharging apparatus can be mounted on top of an image forming apparatus. When the discharging apparatus is dismounted from the image forming apparatus, the image forming apparatus discharges recording media through its discharging portion. When the discharging apparatus is mounted on the image forming apparatus, the switching device can guide recording media to the recording medium introducing section of the discharging apparatus. The switching device is fitted to the discharging apparatus, not to the image forming apparatus. It is therefore possible to manufacture the image forming apparatus as an independent image forming apparatus without raising the costs for the image forming apparatus.

The switching device may include a flapper which can pivot between a first guide position where it guides recording media to the discharging portion of the image forming apparatus and a second guide position where it guides recording media to the recording medium introducing section. The switching device may also include a drive for driving the flapper. The recording medium discharging apparatus may include an urging device for urging the flapper toward the second guide position. The discharging apparatus may also include a transmitting device. When the discharging apparatus is mounted on the image forming apparatus, the transmitting device causes no urging force of the urging device to act on the flapper. When the discharging apparatus is dismounted from the image forming apparatus, the transmitting device causes the urging force of the urging device to act on the flapper. The discharging apparatus is thus constructed for the following reason.

The image forming apparatus may have a top opening through which recording media can be conveyed from the image forming apparatus to the recording medium discharging apparatus. The opening should be as small as possible to prevent dust, rubbish, etc. from entering the image forming apparatus. On the other hand, the discharging apparatus needs to be mounted smoothly on the image forming apparatus, with the flapper inserted into the opening without interfering with the opening. For this purpose, when the discharging apparatus is in the process of being mounted on the image forming apparatus, the transmitting device causes the flapper to be urged to the second guide position, where the flapper does not interfere with the opening.

Otherwise, when the recording medium discharging apparatus is mounted on the image forming apparatus, the urging force of the urging device might be applied to the flapper. This could cause the recording media to be conveyed from the image forming apparatus to the discharging apparatus when the discharging apparatus has been mounted.

BRIEF DESCRIPTION OF THE DRAWINGS

A preferred embodiment of the present invention is shown in the accompanying drawings, in which:

FIG. 13A is a schematic side view in cross section of the sorter.

FIG. 13B is a schematic side view in cross section of the sorter, showing how two sorting units are mounted;

DETAILED DESCRIPTION OF THE PREFERRED EMBODIMENT

Figure 1:
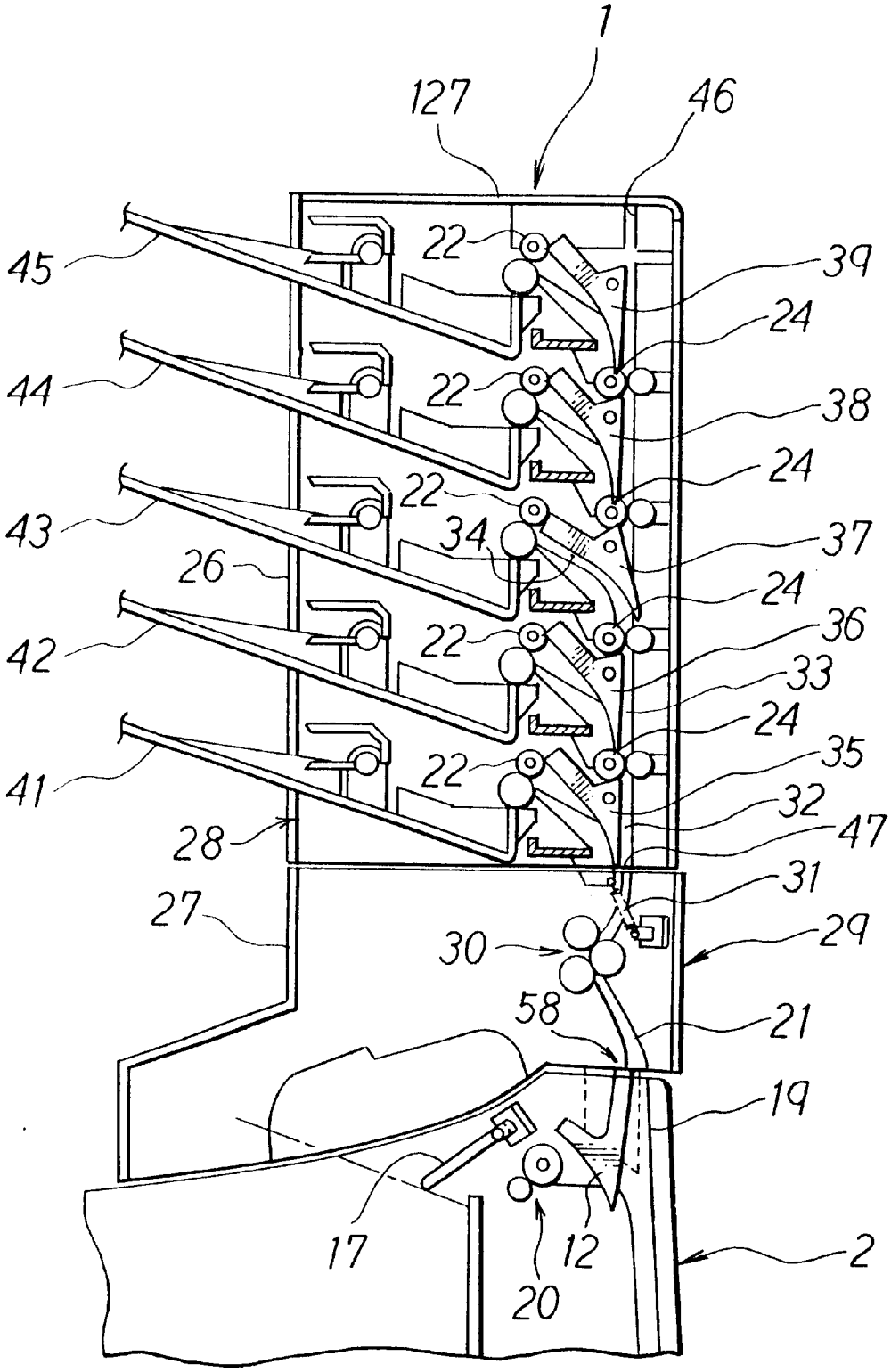
FIG. 1 is a schematic side view in cross section of a sorter embodying the invention and a laser printer, on which the sorter is mounted.

FIG. 1 shows a laser printer 2 as an image forming apparatus, which is fitted with a sorter 1 as a recording medium processor according to the present invention. The sorter 1 is mounted removably on top of the printer 2.

The printer 2 includes a sheet cassette 3 for storing in it sheets of paper as recording media, an image forming unit 4 for forming a toner image, a fixing unit 5 for fixing the toner image transferred onto a sheet of paper, discharge rollers 15 for discharging a sheet of paper with a toner image fixed on it, and a discharge tray 16 for storing or holding a sheet of paper discharged by the rollers 15. The cassette 3, the units 4 and 5, the rollers 15, and the tray 16 are arranged in order in the direction of sheet flow.

Sheets of paper are stacked in the sheet cassette 3, which is positioned at the bottom of the printer 2. The cassette 3 includes a support plate 10 for supporting the stacked sheets. One end of the plate 10 is urged upward by a compression spring 131. Provided near the urged end of the plate 10 are a feed roller 11 and a frictional separation pad 132 for separating one of the stacked sheets at a time and feeding the separated sheets in order from the cassette 3 to the image forming unit 4.

The image forming unit 4 and the fixing unit 5 are positioned over or above the sheet cassette 3 in the printer 2. The image forming unit 4 includes a photosensitive drum 6, a development processor (not shown) and a charger (not shown). After the drum 6 is charged, the image forming unit 4 forms a toner image by developing with toner an electrostatic latent image formed by scanning for exposure with a laser scanner 133. Provided under the drum 6 is a transfer roller 7 for transferring onto a sheet of paper the toner image formed on the drum. The fixing unit 5 includes a heating roller 8 and a pressing roller 9 opposite it. A sheet of paper fed from the cassette 3 is fed to the nip between the photosensitive drum 6 and the transfer roller 7 of the image forming unit 4, where a toner image is transferred onto the sheet. The sheet is moved from the image forming unit 4 to the nip between the heating roller 8 and the pressing roller 9 of the fixing unit 5, where the transferred toner image is fixed. The sheet is moved from the fixing unit 5 to the discharge rollers 15.

Formed downstream of the discharge rollers 15 are a first guide passage 18 and a second guide passage 19 for guiding to the discharge tray 16 and the sorter 1, respectively, the sheets discharged from the rollers 15.

The discharge tray 16 is positioned downstream of the first guide passage 18. Sheets of paper discharged from the discharge rollers 15 can be received by and stacked on the tray 16. The tray 16 is positioned in a recess formed in an upper portion of the printer 2. The front end of the tray 16 is supported rotatably, and the rear end is urged upward by a compression spring 134. As sheets of paper are stacked on the tray 16, their increasing weight turns it gradually downward around its front end. This makes it possible to stack a large number of sheets in aligned condition.

Provided over or above the rear end of the discharge tray 16 is a level sensor 17 for detecting the tray being filled with stacked sheets of paper. The sensor 17 includes a pivotable detecting lever for contact by its own weight with the top one of the sheets stacked on the tray 16. The sensor 17 detects the filled tray 16 when sheets of paper are stacked up to the position indicated by a phantom line F, and consequently the detecting lever does not pivot downward beyond this position. Provided in the first guide passage 18 are uncurling rollers 20 for uncurling a sheet of paper.

Figure 2:
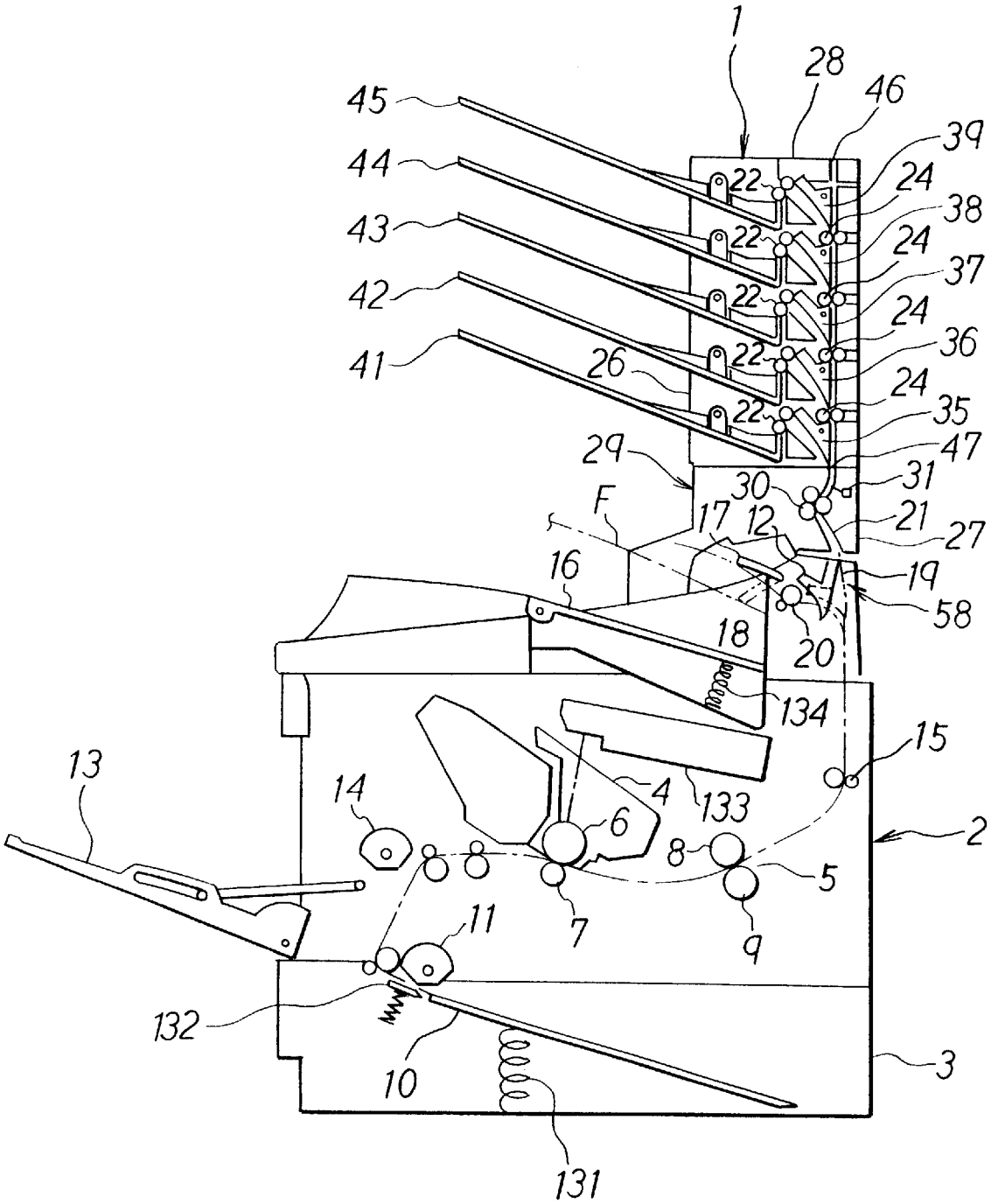
FIG. 2 is an enlarged schematic side view in cross section of the sorter.

The printer 2 includes a manual feed tray 13 and a feed roller 14 for feeding a sheet of paper placed on this tray. With reference to FIG. 2, the sorter 1 includes an adapter or adapting unit or recording medium receiver 29 as an introducing section for introducing a sheet of paper with an image formed on it by the printer 2 into the sorter 1. The sorter 1 also includes a sorting unit 28 as a processing unit, which is mounted removably on top of the adapter 29.

The printer 2 includes a manual feed tray 13 and a feed roller 14 for feeding a sheet of paper placed on this tray. With reference to FIG. 2, the sorter 1 includes an adapter or adapting unit 29 as an introducing section for introducing a sheet of paper with an image formed on it by the printer 2 into the sorter 1. The sorter 1 also includes a sorting unit 28 as a processing unit, which is mounted removably on top of the adapter 29.

The adapter 29 has an introducing passage 21 formed through its casing 27. This passage 21 is for introducing a sheet of paper. The adapter 29 includes in the casing 27 a count lever 31 for detecting a sheet of paper introduced into the passage 21. The adapter 29 also includes uncurling rollers 30 for uncurling the introduced sheet. The adapter 29 is fitted with a selectively switching mechanism 58 as selectively switching device for guiding a sheet of paper selectively to the discharge tray 16 of the printer 2 or the introducing passage 21 of the sorter 1.

Figure 3:
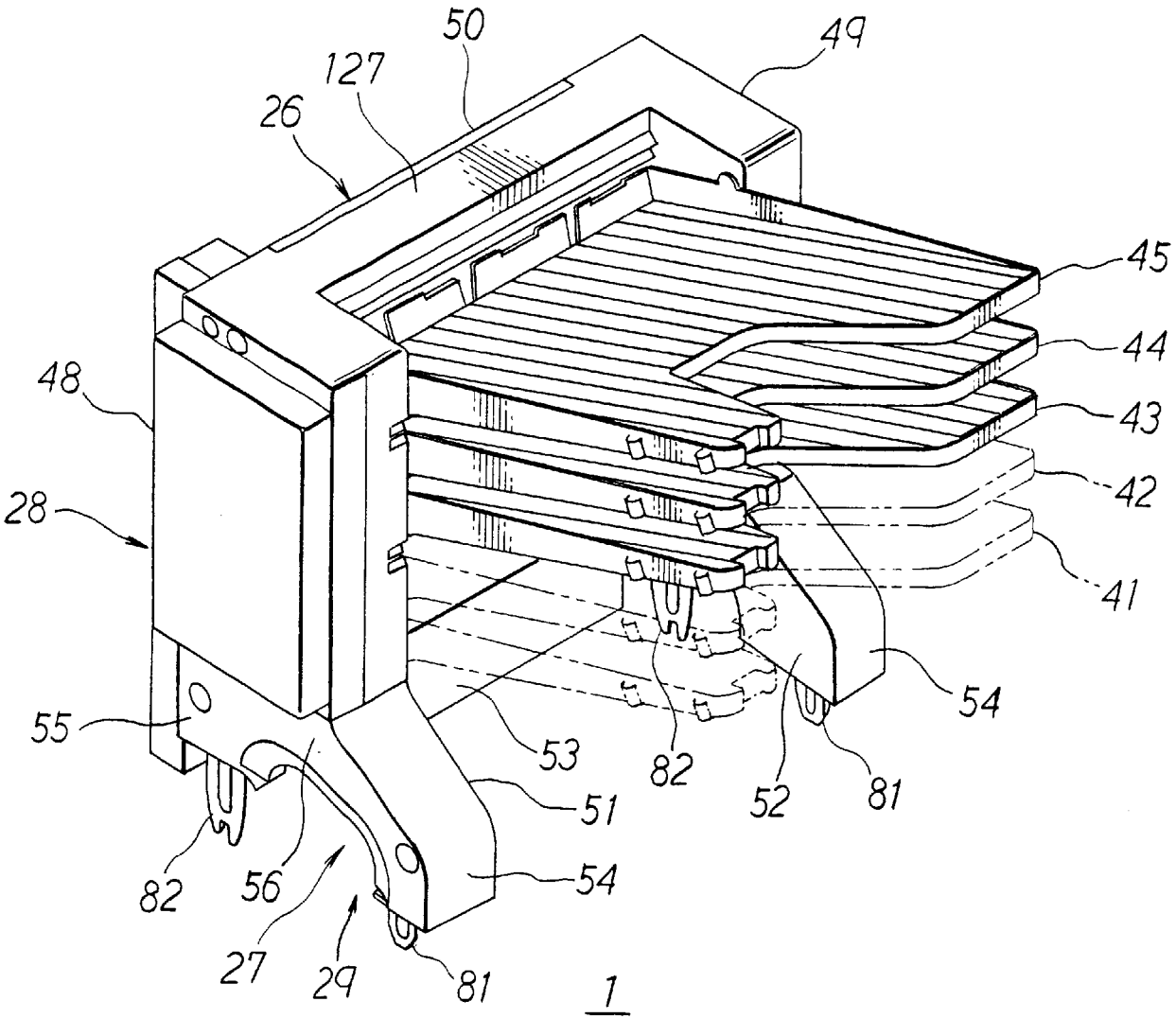
FIG. 3 is a perspective view of the sorter.

As shown in FIG. 3, the adapter casing 27 includes a rectangular trunk or body 53 and side portions 51 and 52. Each of these portions 51 and 52 extends forward from one end of the body 53. Each of the side portions 51 and 52 generally takes the form of an inverted U in side view. These portions 51 and 52 each include a trunk or body 56, a front leg 54 and a rear leg 55. The rear leg 55 extends straight downward from the trunk 56. The front leg 54 first extends downward and forward from the trunk 56, and then extends downward. Provided in each of the side portions 51 and 52 is a support plate 57 (FIG. 7), which will be described below in detail. This plate 57 includes a front fitting portion 81 and a rear fitting portion 82 as fitting members for fitting on the printer 2.

As shown in FIG. 2, the introducing passage 21 extends generally vertically through the adapter 29 so that a sheet of paper discharged from the discharge rollers 15 of the printer 2 can be conveyed through this passage to the sorting unit 28. The nips between the uncurling rollers 30 are positioned in the passage 21, which extends across the count lever 31. This lever 31 is positioned upstream of the uncurling rollers 30.

As described below in detail, the selectively switching mechanism 58 protrudes downward from the adapter 29, and is inserted into the printer 2 when the adapter 29 is mounted on the printer. The switching mechanism 58 includes a selecting flapper 12 which can pivot between a first guide position as indicated by phantom lines in FIG. 1, where the flapper guides a sheet of paper toward the discharge tray 16, and a second guide position as indicated by solid lines in FIG. 1, where the flapper guides a sheet of paper toward the introducing passage 21. In accordance with the guide position of the flapper 12, a sheet of paper from the discharge rollers 15 is guided selectively to one of the guide passages 18 and 19. The flapper 12 is controlled by a CPU (not shown) and can be actuated by a solenoid 61 which will be described below.

By fitting the switching mechanism 58 to the adapter 29, it is possible for the sorter 1 to include all the members and/or parts for determining the direction of sheet discharge. This makes the printer 2 simpler in structure, thereby preventing wasteful cost increase for the printer.

The sorting unit 28 includes a casing 26, which has an inlet 47 formed at its bottom. A sheet of paper from the introducing passage 21 of the adapter 29 passes through the inlet 47 into the sorting unit 28. This unit 28 also includes a first bin 41, a second bin 42, a third bin 43, a fourth bin 44 and a fifth bin 45 for storing or holding sheets of paper. The unit 28 includes, in its casing 26, pairs of discharge rollers 22 as discharging devices for discharging sheets of paper to the respective bins 41–45. The unit 28 also includes pairs of conveying rollers 24 as a conveying device for conveying, to the discharge rollers 22, sheets of paper passing from the inlet 47. The unit 28 further includes a first switching flapper 35, a second switching flapper 36, a third switching flapper 37, a fourth switching flapper 38 and a fifth switching flapper 39 as direction switching devices for guiding, to the respective pairs of discharge rollers 22, sheets of paper passing from the inlet 47. The casing 26 has an outlet 46 formed at its top, through which a sheet of paper conveyed by the conveying rollers 24 can be discharged upward from the unit 28. The unit 28 has a conveying passage 32, which includes a vertical stem or trunk 33 and five branches 34. The stem 33 is formed vertically through the unit 28, and extends between the inlet 47 and the outlet 46. The branches 34 extend from the stem 33 toward the respective pairs of discharge rollers 22, and open to them. This passage 32 guides sheets of paper from the inlet 47 to the discharge rollers 22 and the outlet 46.

As shown in FIG. 3, the casing 26 of the sorting unit 28 includes a rectangular trunk or body 50 and side portions 48 and 49. These portions 48 and 49 each extend forward from one end of the body 50.

Each of the bins 41–45 generally takes the form of a plate to receive and store or hold sheets of paper. Rear end portions of the bins 41–45 are supported by the body 50 and the side portions 48 and 49 of the casing 26. The bins 41–45 extend forward and upward, and their front end portions protrude forward beyond the side portions 48 and 49. The bins 41–45 are arranged in vertical alignment.

As shown in FIGS. 1 and 2, the pairs of discharge rollers 22 are positioned over or above the rear ends of the respective bins 41–45. One of the discharge rollers 22 of each pair is driven, and the other roller follows the driven roller.

Each of the switching flappers 35–39 is supported pivotably on its horizontal axis positioned over the rear end of the associated branch 34 of the conveying passage 32. Each of these flappers 35–39 can pivot between a third guide position (the position of the third flapper 37 in FIG. 2), where it guides a sheet of paper to the associated discharge rollers 22, and a fourth guide position (the position of the switching flappers other than the third flapper 37 in FIG. 2), where it guides a sheet of paper vertically. In accordance with the guide positions of the flappers 35–39, sheets of paper having entered the sorting unit 28 are guided from the vertical stem 33 to arbitrary branches 34 of the passage 32.

The pairs of conveying rollers 24 for conveying sheets of paper vertically are positioned between the switching flappers 35–39 along the vertical trunk 33 of the conveying passage 32. One of the conveying rollers 24 of each pair is driven, and the other roller follows the driven roller.

The sorting unit 28 includes a motor (not shown) as a motive power source for driving the discharge rollers 22 and the conveying rollers 24 through gear trains (not shown). This motor can also drive the uncurling rollers 30 of the adapter 29, which includes no motor.

Sheets of paper discharged from the printer 2 can be stored by the bins 41–45 of the sorter 1 in the following manner. If the selecting flapper 12, which has been inserted in the printer 2, is switched to the second guide position (solid lines in FIG. 1), this flapper guides to the introducing passage 21 of the sorter adapter 29 a sheet of paper discharged by the discharge rollers 15 of the printer. The sheet in this passage 21 is uncurled by the uncurling rollers 30, and then pushes the count lever 31. Thereafter, the sheet passes through the inlet 47 into the conveying passage 32 of the sorting unit 28.

Because the uncurling rollers 30 are provided in the adapter 29, a sheet of paper is uncurled immediately before it is sorted and stored in the sorting unit 28. The uncurled sheet smoothly enters the sorting unit 28. This makes it possible to store sheets of paper in an orderly manner in the bins 41–45 and restrain sheets of paper from being jammed.

When the count lever 31 is pushed, a detection signal is output, causing the CPU (not shown) to judge that a sheet of paper has entered the sorter 1. Thus, by providing this lever 31 in the adapter 29, it is possible to determine whether a sheet of paper has entered the sorter 1. Therefore, when a sheet of paper is jammed, it is easy to judge whether the sheet is jammed in the printer 2 or the sorter 1.

A sheet of paper having entered the conveying passage 32 can be conveyed upward in the vertical passage stem 33 by the conveying rollers 24. When the sheet reaches the switching flapper 35, 36, 37, 38 or 39 in the third guide position, this flapper guides the sheet to the associated discharge rollers 22. In more detail, the flappers 35–39 are controlled by the CPU (not shown) and can each be actuated by a solenoid (not shown). When a sheet of paper should be discharged to one of the bins 41–45, the associated flapper 35, 36, 37, 38 or 39 is turned to the third guide position, with the other switching flappers in the fourth guide position.

As shown in FIG. 2, there may be a case where sheets of paper should be discharged to the third bin 43. In this case, only the third switching flapper 37 is in the third guide position, while the other switching flappers 35, 36, 38 and 39 are in the fourth guide position. After a sheet of paper enters the conveying passage 32, the sheet is conveyed in the vertical passage stem 33 up to the third flapper 37 in the third guide position by the conveying rollers 24 below this flapper. This flapper 37 turns the sheet to the associated passage branch 34. The turned sheet is then discharged by the associated discharge rollers 22 to the third bin 43.

In the case shown in FIG. 2, a sheet of paper from the introducing passage 21 is conveyed without slowing down in the vertical passage stem 33 by the conveying rollers 24 below the third switching flapper 37 until the sheet reaches this flapper. After the sheet is turned by the third flapper 37 to the associated passage branch 34, the sheet is completely discharged without slowing by the associated discharge rollers 22 to the third bin 43. Therefore, the sorter 1 can reliably, at high speed, sort and store sheets of paper on which images have been formed by the printer 2.

Figure 4:
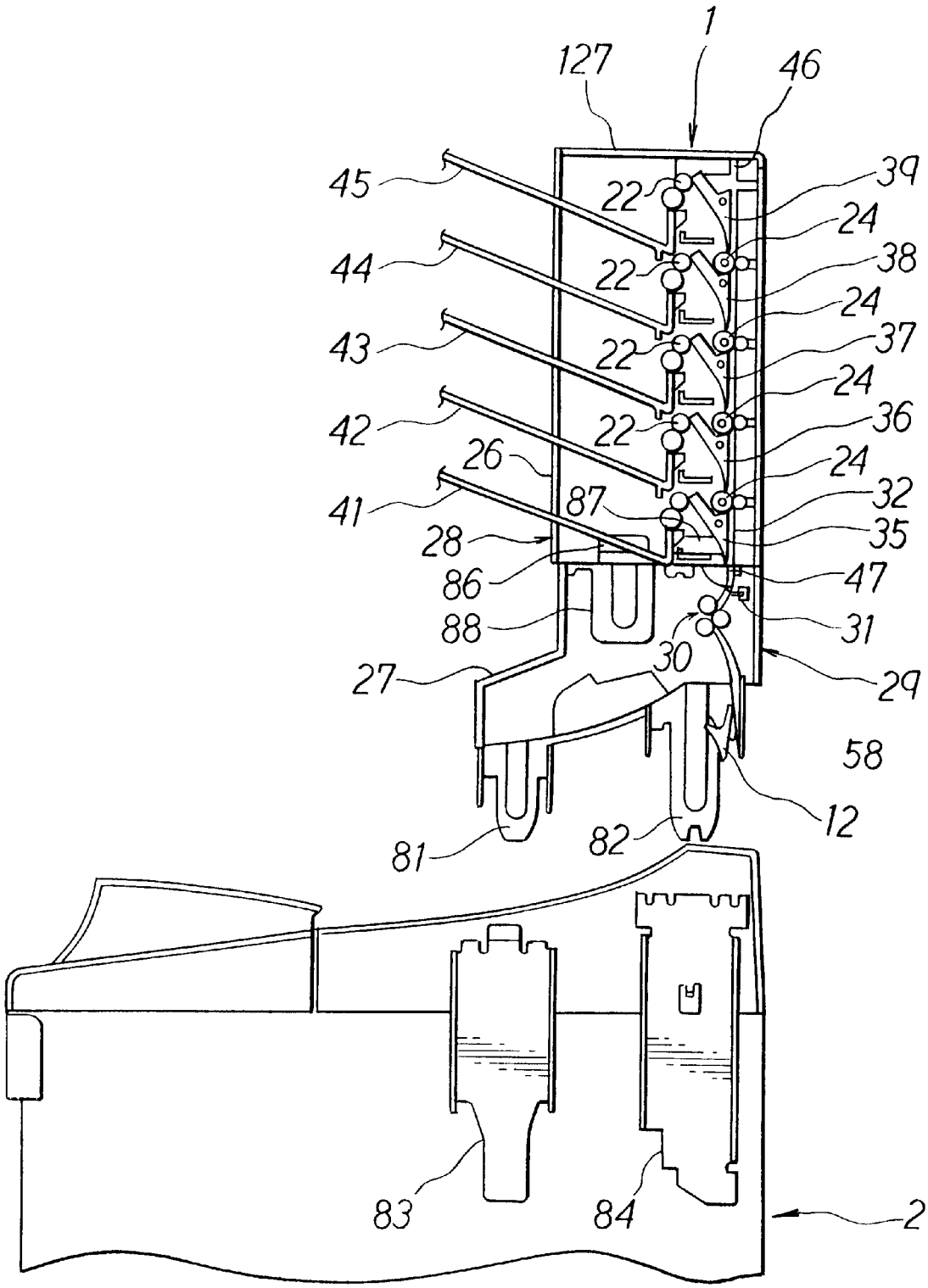
FIG. 4 is a schematic side view in cross section of the sorter, showing how the sorter is mounted on the printer.
Figure 5:
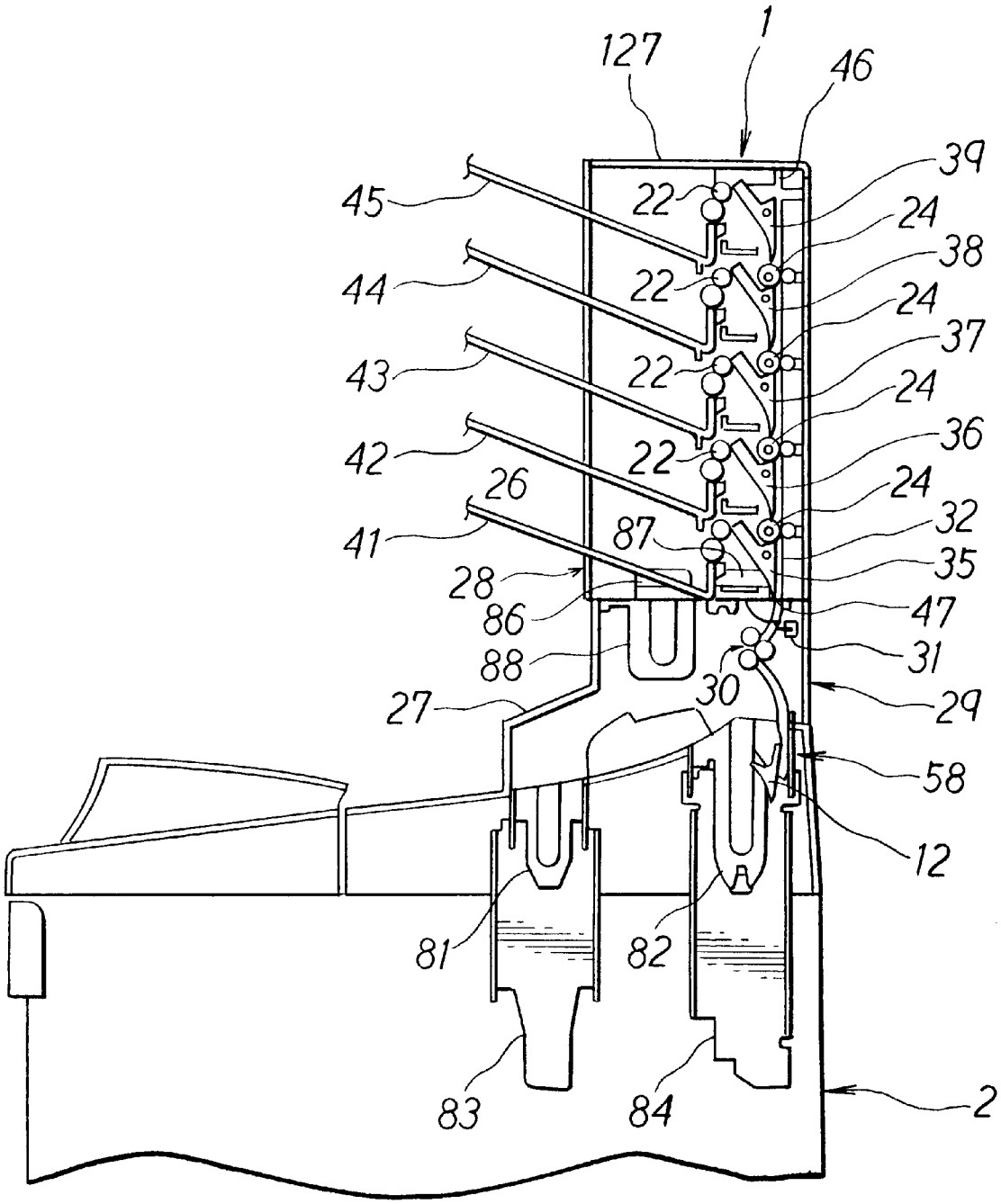
FIG. 5 is a schematic side view in cross section of the sorter mounted on the printer.
Figure 6:
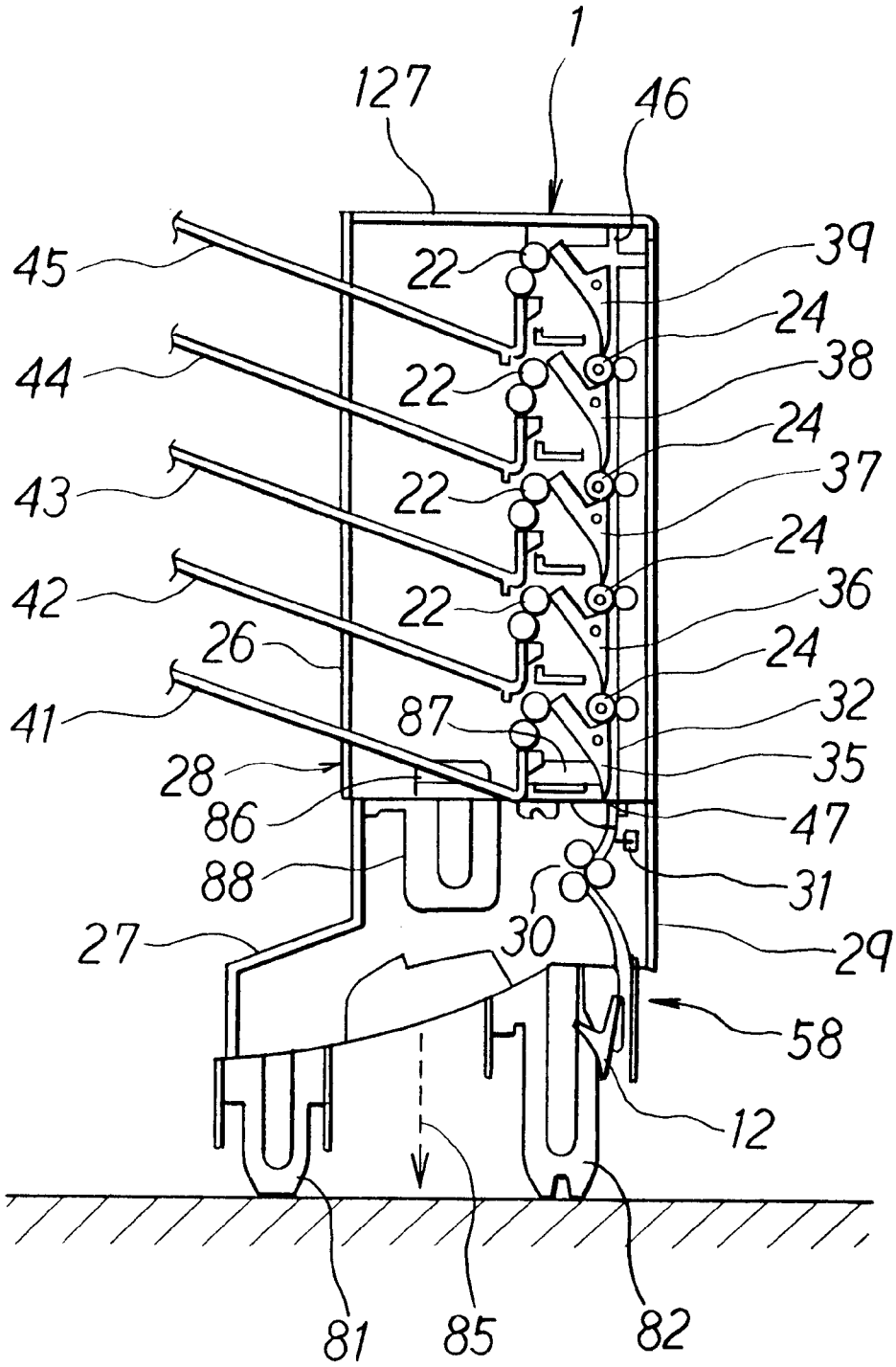
FIG. 6 is a schematic side view in cross section of the sorter placed on a floor.

With reference to FIGS. 3–6, the sorter 1 can be mounted on and dismounted from the printer 2 as follows. In FIGS. 4–6, locking mechanisms are not shown, which will be described below. As shown in FIGS. 3–6, the front fitting portion 81 of the support plate 57 of each side portion 51 or 52 of the adapter casing 27 protrudes downward from the front leg 54 of the side portion. Likewise, the rear fitting portion 82 of each side portion 51 or 52 protrudes downward from the rear leg 55 of the side portion. The fitting portions 81 and 82 are substantially rectangular, and each include a thin bottom portion. Each front fitting portion 81 has a flat bottom surface for surface contact with another surface. The bottom portion of each rear fitting portion 82 is bifurcated and has round bottom surfaces for surface contact with another surface. The bottom surfaces of the fitting portions 81 and 82 are substantially in horizontal alignment. These portions 81 and 82 surround the center of gravity (dotted line 85 in FIG. 6) of the sorter 1.

The printer 2 includes a pair of front holding plates 83 and a pair of rear holding plates 84, all of which are provided in its upper portion. The front holding plates 83 are located for engagement with the respective front fitting portions 81 of the support plates 57 of the sorter 1. The rear holding plates 84 are located for engagement with the respective rear fitting portions 82.

With the front fitting portions 81 engaging with and positioned by the respective front holding plates 83, these portions can be held by these plates. With the rear fitting portions 82 engaging with and positioned by the respective rear holding plates 84, these portions can be held by these plates. By inserting each of the fitting portions 81 and 82 from above into the associated holding plate 83 or 84, as shown in FIG. 4, and engaging them, as shown in FIG. 5, it is possible to mount the sorter adapter 29 on the printer 2. In FIG. 5, each of the fitting portions 81 and 82 is positioned by the associated holding plate 83 or 84. This makes the sorter 1 mounted stably in an upright or standing position on the printer 2.

It is possible to dismount the sorter 1 from the printer 2 by lifting the adapter 29 in an upright position to pull each of the fitting portions 81 and 82 out of the associated holding plate 83 or 84. The sorter 1 may be dismounted from the printer 2 with a user's hands holding the trunks 56 of the side portions 51 and 52 of the adapter casing 27. Because the trunks 56 are positioned substantially on a vertical plane extending through the center of gravity 85 of the sorter 1, the sorter can be lifted in balance.

When the sorter 1 is placed on a floor, as shown in FIG. 6, the bottoms of the fitting portions 81 and 82 are substantially in horizontal alignment. These portions 81 and 82 surround the center of gravity 85 of the sorter 1. It is preferable that, as shown in FIG. 6, the center 85 be positioned substantially at the midpoint between a vertical plane extending through the front fitting portions 81 and a vertical plane extending through the rear fitting portions 82. It is also preferable that the center 85 be positioned substantially at the midpoint between two vertical planes each extending through the fitting portions 81 and 82 on one side. Therefore, the sorter 1 can rest on the floor stably, without toppling or falling down, substantially in the same upright position as it is mounted on the printer 2. Therefore, it is not necessary to lay the sorter 1 down on a floor, lean it against a wall and support it with a member, and it is easy to dismount the sorter 1 from the printer 2, store the dismounted sorter and mount the dismounted sorter again on the printer. Because the sorter 1 can contact with the floor with the bottom surfaces of the fitting portions 81 and 82, it is possible to well keep the sorter 1 mounted stably on the floor.

The fitting portions 81 and 82, which are provided as fitting members used when the sorter 1 is mounted on the printer 2, function as legs when the sorter is dismounted from the printer and placed on a floor. Therefore, there is no need to provide special or extra legs other than the fitting portions 81 and 82, with which to place the sorter 1 stably on a floor. This simplifies the structure of the sorter 1 and reduces the number of parts of the sorter.

The sorter 1 is mounted in an upright position on the printer 2. After the sorter 1 is dismounted from the printer 2, the sorter is placed still in an upright position on a floor. In other words, the sorter 1 is mounted and dismounted substantially in the same position. Therefore, the sorter 1 can be dismounted from the printer 2 by being lifted in an upright position, and then be placed still in the same position on a floor. Likewise, the sorter 1 placed in the upright position on the floor can be lifted still in the same position, and then be mounted still in this position from above on the printer 2. It is therefore easier to mount the sorter 1 on and dismount it from the printer 2.

Figure 7:
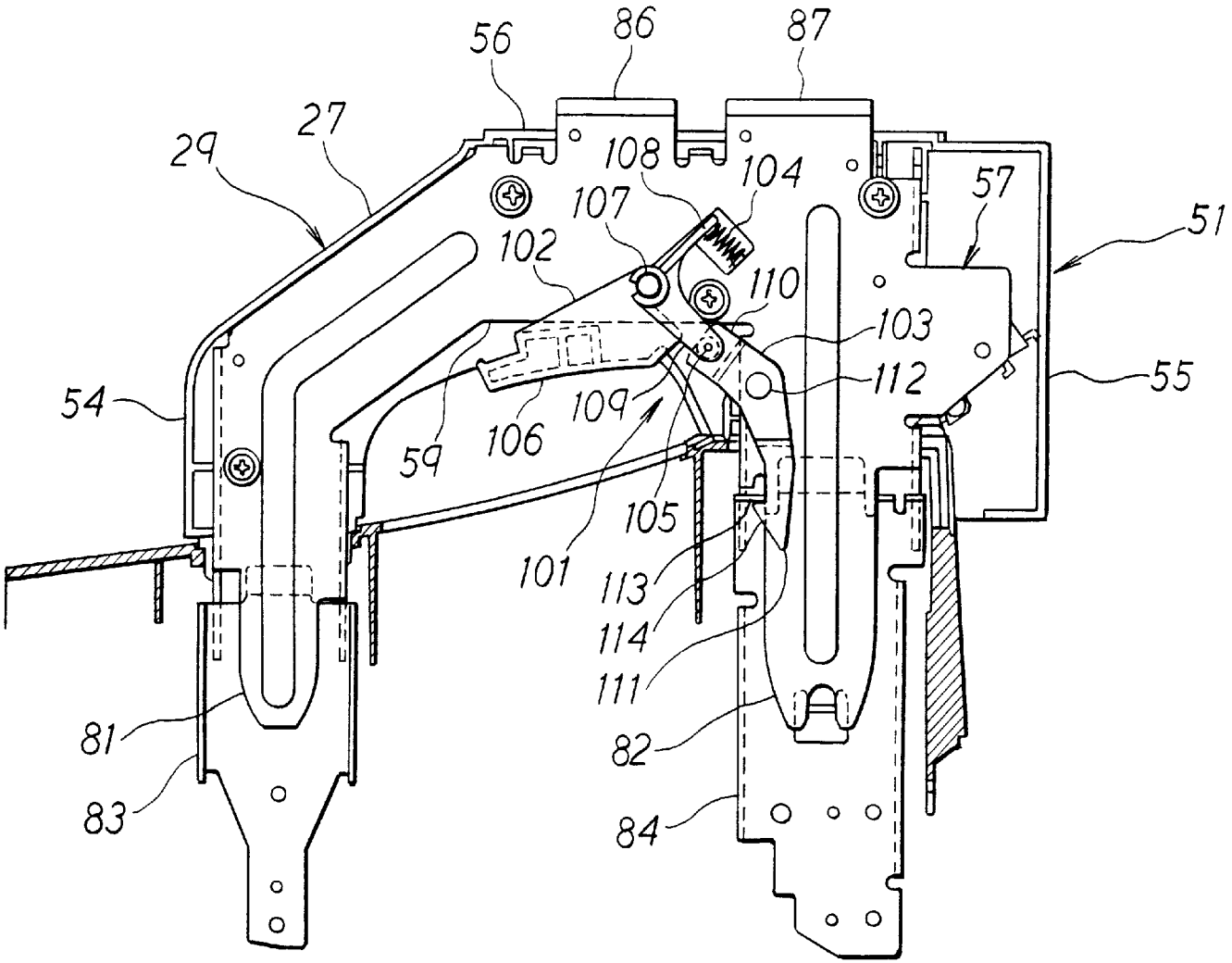
FIGS. 7 and 8 are side views of the adapter of the sorter, but the left side cover of the casing of the adapter has been removed in order for the locking mechanisms of the sorter to be shown.
Figure 8:
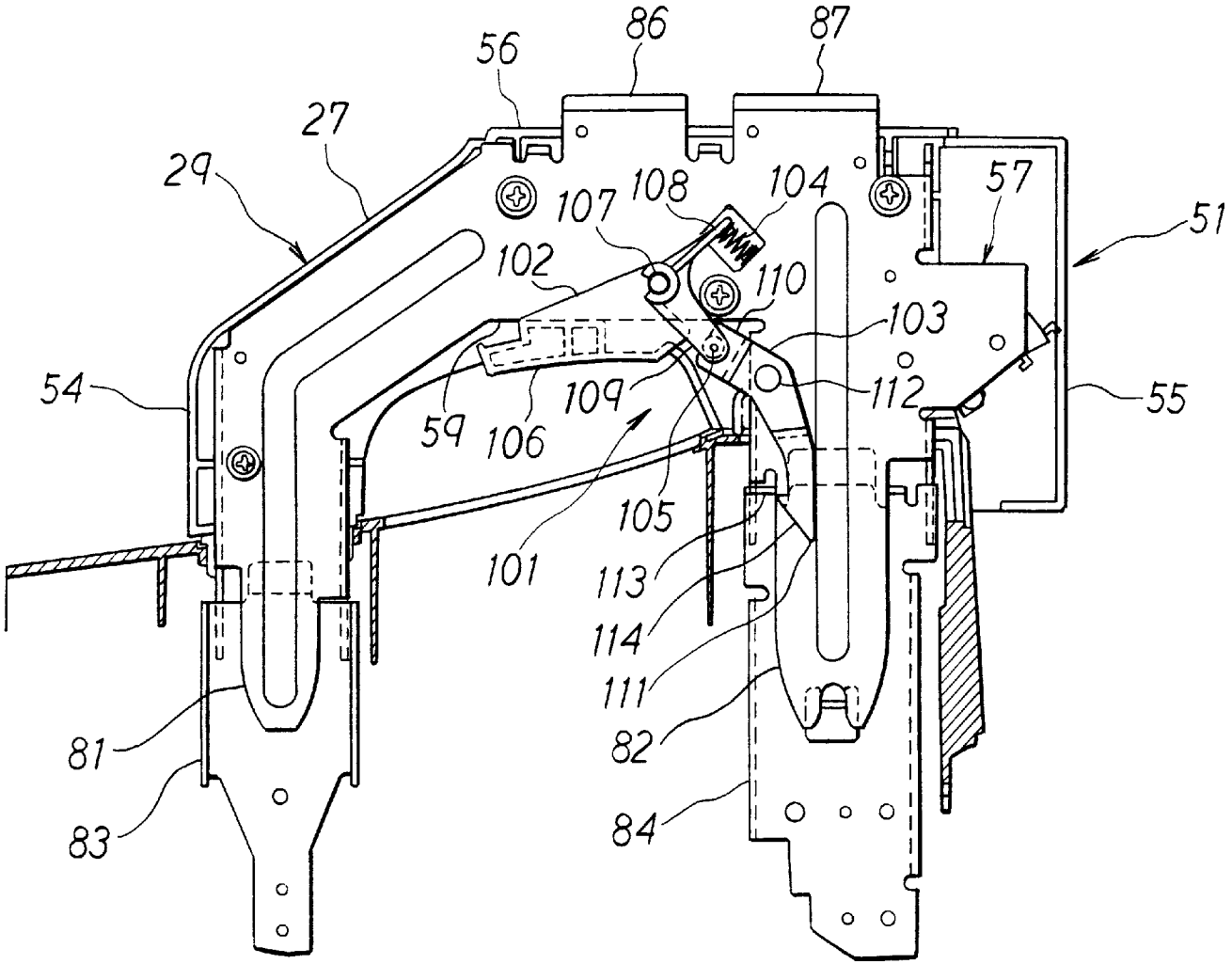

FIGS. 7 and 8 are left side views of the sorter adapter 29, but the side cover (not shown) of the left side portion 52 of the adapter casing 27 is removed. With reference to FIGS. 7 and 8, the sorter 1 includes two locking mechanisms 101 (only one shown in FIGS. 7 and 8) for keeping it mounted on the printer 2. These mechanisms 101 are provided in the respective side portions 51 and 52 of the casing 27.

With reference to FIG. 7, each of the support plates 57 of the sorter adapter 29 includes a trunk or body 59 integrally connecting the tops of the associated fitting portions 81 and 82. Each of the locking mechanisms 101 is provided on the trunk 59 and a top portion of the rear fitting portion 82 of the associated support plate 57. Each locking mechanism 10 includes a lever 102, a pivot or swing member 103 as first engaging portion, a compression spring 104 as an urging device, and a link 105. The pivot member 103 interlocks or works with the lever 102. The link 105 links the lever 102 and the pivot member 103 together.

The lever 102 is supported pivotably by the associated support plate 57 in such a manner that it can be positioned partially under the trunk 56 of the associated side portion 51 or 52 of the adapter casing 27. The lever 102 includes an operating portion 106 for manual operation or manipulation, a horizontal support pin 107, a spring shoe or seat 108 and a connector 109. The operating portion 106, the pin 107, the shoe 108 and the connector 109 are formed integrally. The pin 107 is supported rotatably on the trunk 59 of the support plate 57 so that the operating portion 106 can pivot up and down around the pin. The pin 107 is positioned at the top of the lever 102 and near the rear end of the lever. The shoe 108 is positioned above and in the rear of the pin 107, and bears one end of the spring 104,the other end of which is fixed to the trunk 59. The connector 109 extends downward and backward from the pin 107, and is connected to the pivot member 103.

Part of the operating portion 106 is positioned under the trunk 56 of the associated side portion 51 or 52 of the adapter casing 27. Through the operating portions 106 of the side portions 51 and 52 extends a vertical plane on which the center of gravity 85 of the sorter 1 is positioned. The spring 104 downward urges the front end of the associated operating portion 106, which is positioned opposite the associated spring shoe 108 with respect to the associated support pin 107.

The pivot member 103 includes a connector 110 as a portion for receiving motive power, a pawl 111, and a horizontal pivot pin 112. This pin 112 is supported rotatably on the top of the rear fitting portion 82 of the support plate 57 in such a manner that the pivot member 103 can pivot around this pin. The connector 110 extends upward and forward from the pin 112 toward the trunk 59 of the plate 57. The pawl 111 extends downward from the pin 112.

Each of the rear holding plates 84 of the printer 2 includes an engaging portion 113 as a second engaging portion formed at its top. The pivot member 103 can pivot between an engaging position, where its pawl 111 engages with the associated engaging portion 113, and a disengaging position, where the pawl disengages from the engaging portion 113. The connectors 110 and 109 of the pivot member 103 and the lever 102, respectively, are linked together by the link 105. The engaging portion 113 protrudes toward the pawl 111 so that it can engage with the pawl. When the sorter 1 is mounted on the printer 2, the engaging portion 113 is positioned in front of the pawl 111. The pawl 111 includes a slope 114 for sliding on the engaging portion 113 to guide the engagement of the pawl with the engaging portion when the sorter 1 is in the process of being mounted on the printer 2.

FIG. 7 shows the sorter 1 as mounted on the printer 2 and locked by the locking mechanisms 101. The spring 104 of each locking mechanism 101 urges the front end of the operating portion 106 of the associated lever 102 downward and the connector 109 of the lever upward. The upward urged connector 109 turns the connector 110 of the associated pivot member 103 upward through the associated link 105, moving the associated pawl 111 forward to the engaging position, where the pawl engages with the associated engaging portion 113 of the printer 2.

FIG. 8 shows the sorter 1 as unlocked in the process of being dismounted from the printer 2. It is possible to unlock the sorter 1 by pushing upward the operating portions 106 of the levers 102 of the locking mechanisms 101. Specifically, when each operating portion 106 is pushed upward against the urging force of the associated spring 104, the associated lever connector 109 turns downward. This turns the connector 110 of the associated pivot member 103 downward through the associated link 105, moving the associated pawl 111 backward to the disengaging position, where the pawl disengages from the associated engaging portion 113 of the printer 2.

When a user mounts the sorter 1 on the printer 2, he or she basically holds the trunks 56 of the side portions 51 and 52 of the adapter casing 27 with both his or her hands, as stated above. Therefore, with a user's hands holding and raising the levers 102 of the side portions 51 and 52, the sorter 1 can be mounted from above on the printer 2. By thus mounting the sorter 1 with the levers 102 held by a user's hands, it is possible for the levers to be turned upward relative to the support plates 57 naturally by the weight of the sorter. The upward turning of each lever 102 moves the associated pawl 111 to the disengaging position, in which the pawl is kept during the mounting operation. This allows the pawl 111 to be inserted smoothly without contacting with the associated engaging portion 113 of the printer 2. When the mounting operation ends, the hands are moved out of contact with the levers 102, causing the urging force of the springs 104 to move the pawls 111 to the engaging position. As a result, as shown in FIG. 7, the pawls 111 engage with the engaging portions 113.

Consequently, while the sorter 1 is mounted on the printer 2, the springs 104 keep the pawls 111 in engagement with the engaging portions 113 of the printer 2, thereby keeping the sorter locked. This fixes the mounted sorter 1 securely to the printer 2. Even if external force is applied to the mounted sorter 1, the sorter hardly tilts or falls from the printer 2. It is therefore possible to hold the sorter 1 reliably on the printer 2.

Otherwise, the sorter 1 may be mounted on the printer 2 without the levers 102 being held. If the sorter 1 is mounted without the levers 102 being operated, the pawls 111 come into engagement with the engaging portions 113. Then, the pawls 111 move against the urging force of the springs 104 to the disengaging position, where they disengage from the engaging portions 113. When the slopes 114 of the pawls 111 disengage from the engaging portions 113, the pawls return to the engaging position, where they are caused by the springs 104 to engage with the engaging portions 113. It is therefore possible to lock the sorter 1 with the locking mechanisms 101 even without operating the levers 102 during the mounting operation.

When a user dismounts the sorter 1 from the printer 2, he or she lifts the sorter with both his or her hands holding the levers 102. In this situation, because the sorter 1 and the levers 102 are moved in the same direction, naturally the levers are turned upward relative to the sorter by the weight of the sorter. The upward turned levers 102 move the pawls 111 to the disengaging position, where the pawls disengage from the engaging portions 113. This makes it possible to unlock the sorter 1 and dismount it from the printer 2 at a time by only holding the levers 102 with a user's hands. It is therefore easy to dismount the sorter 1 from and mount it on the printer 2.

The levers 102 are positioned partially under the trunks 56 of the side portions 51 and 52 of the adapter casing 27. As stated above, a user holds the trunks 56 with his or her hands when he or she mounts the sorter 1 on and dismounts it from the printer 2. When a user dismounts the sorter 1 from the printer 2, he or she holds the levers 102 as well as the trunks 56. That is to say, it is possible to carry out the holding for removal and the lever operation by holding the same parts. This makes it possible to dismount the sorter 1 more efficiently.

The operating portions 106 of the levers 102 are positioned partially under the respective trunks 56 of the side portions 51 and 52 of the adapter casing 27. Through the operating portions 106 extends a vertical plane on which the center of gravity 85 of the sorter 1 is positioned. Therefore, when the sorter 1 is lifted with the levers 102 held by a user's hands, it can be held in balance. Therefore, by mounting and dismounting the sorter 1 with the levers 102 held by a user's hands, it is possible to hold the sorter in balance. This enables the sorter 1 to be mounted on and dismounted from the printer 2 stably.

When the connectors 110 of the pivot members 103 turn upward, these members pivot so that their pawls 111 can engage with the engaging portions 113 of the rear holding plates 84. There may be a case where external force is applied to pull upward the sorter 1 mounted on the printer 2. This may turn the connectors 110 of the pivot members 103 upward. In this case, the pawls 111 do not disengage from the engaging portions 113, rather engage more firmly or strongly with them. Therefore, even if external force is applied to the sorter 1 mounted on the printer 2, the pawls 111 do not disengage accidentally from the engaging portions 113. This makes it possible to more reliably or securely hold the sorter 1 mounted on the printer 2.

As stated before, when the sorter 1 is mounted on the printer 2, the pawls 111 of the pivot members 103 are moved to the engaging position, where they engage with the engaging portions 113 of the printer. This makes it possible to securely hold the sorter 1 mounted on the printer 2. Therefore, even if external force is applied to the sorter 1, the sorter hardly tilt or fall from the printer 2. It is consequently possible to keep the sorter 1 operating in good condition, and prevent or restrain the sorter from being damaged by falling down.

As also stated, when the sorter 1 is in the process of being dismounted from the printer 2, the sorter is lifted in an upright position with a user's hands holding the levers 102 of the locking mechanisms 101. This moves the pawls 111 of the pivot members 103 to the disengaging position, where the pawls disengage from the engaging portions 113 of the printer 2. The disengagement allows the sorter 1 to be dismounted easily from the printer 2.

Thus, by moving the pawls 111 of the pivot members 103 between the engaging and disengaging positions, it is possible to securely hold the sorter 1 mounted on the printer 2, while it is easy or simple to mount the sorter on and dismount it from the printer.

Figure 9:
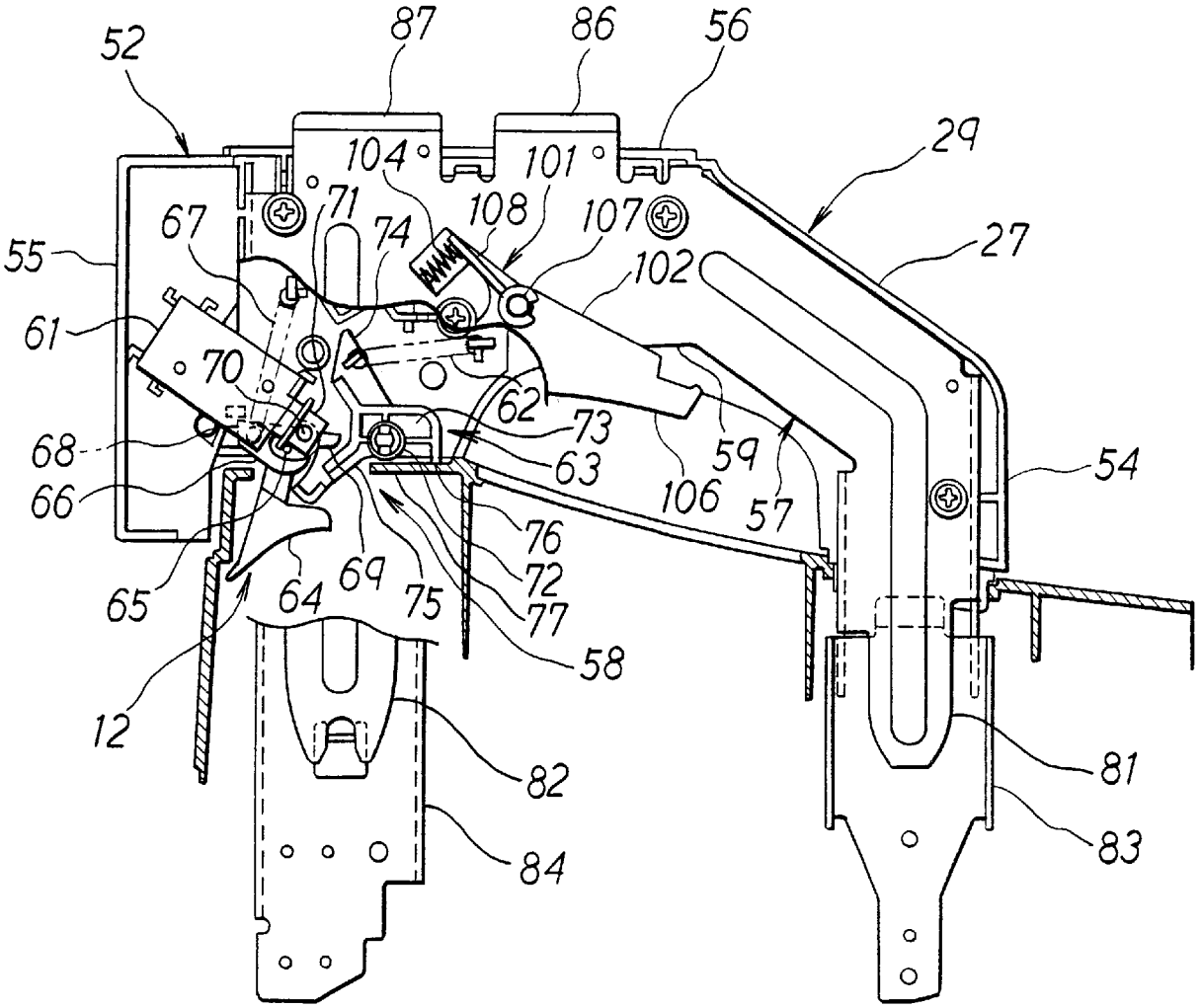
FIG. 9 is a partially broken side view of the sorter adapter mounted on the printer, but the right side cover of the adapter casing has been removed so that the selectively switching mechanism of the sorter can be shown.
Figure 10A:
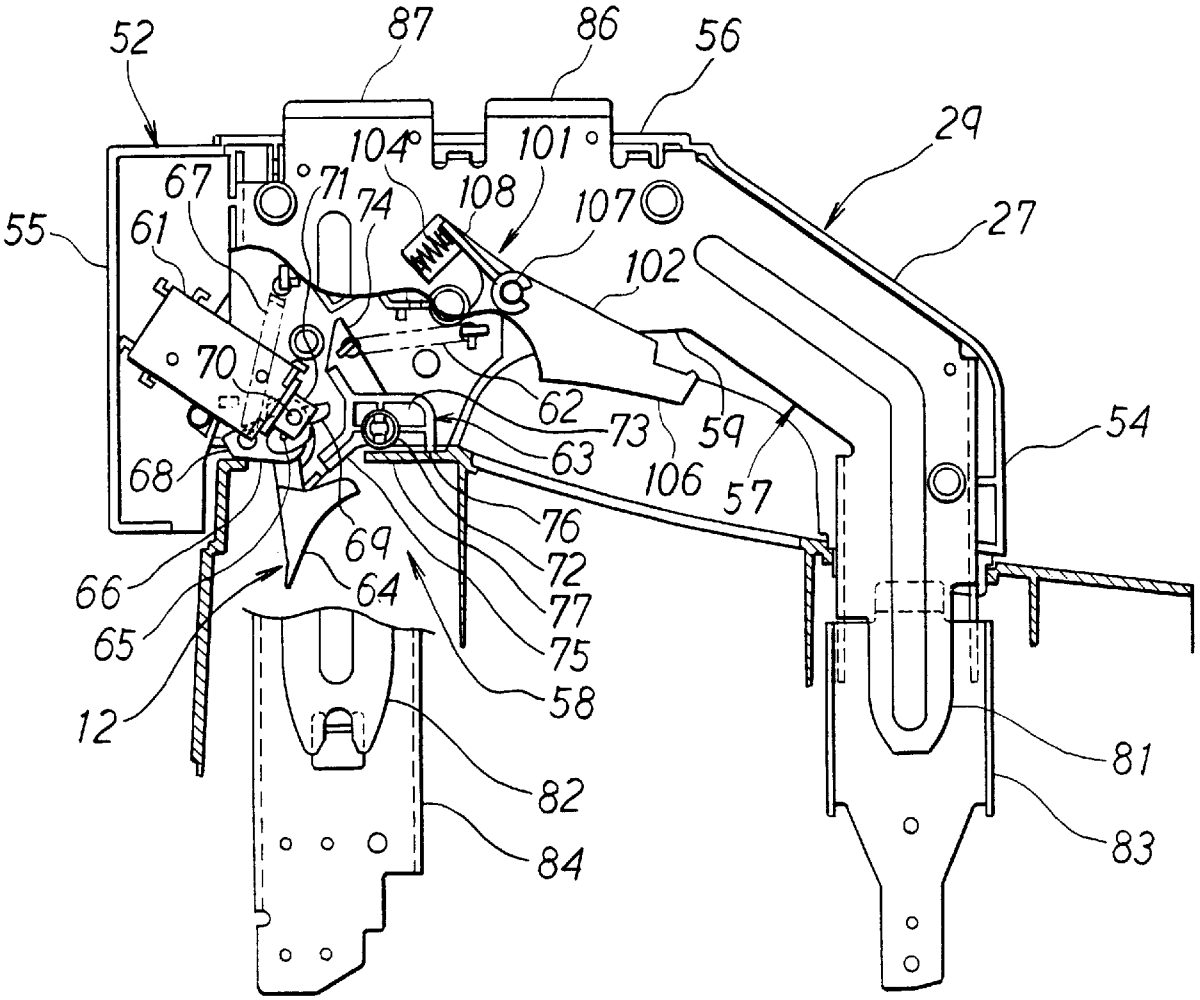
FIG. 10A is another partially broken side view of the sorter adapter mounted on the printer, but the right side cover of the adapter casing has been removed so that the switching mechanism can be shown.
Figure 10B:
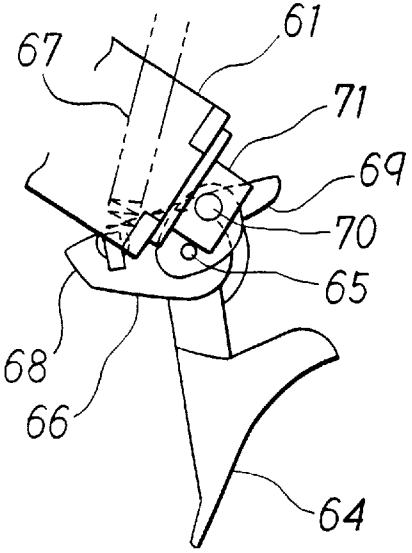
FIG. 10B is an enlarged view of the selecting flapper and the solenoid of the switching mechanism shown in FIG. 10A.
Figure 11:
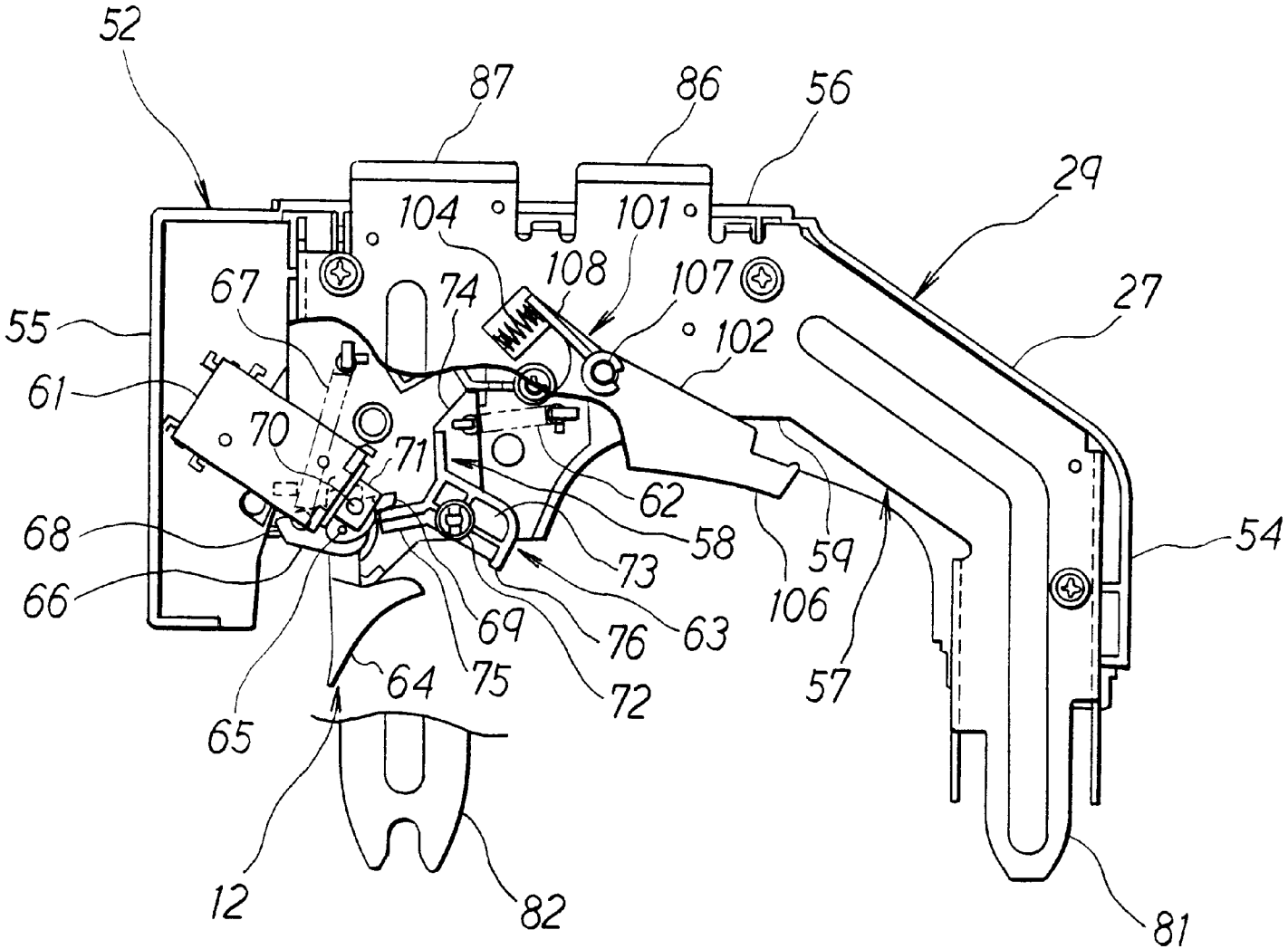
FIG. 11 is a partially broken side view of the sorter adapter dismounted from the printer, but the right side cover of the adapter casing has been removed in order for the switching mechanism to be shown.

FIGS. 9–11 are right side views of the sorter adapter 29, but the right side cover (not shown) of the right side portion 51 the adapter casing 27 is removed. FIGS. 9 and 10A show the sorter 1 as mounted on the printer 2. FIG. 10B is an enlarged view of the selecting flapper and the solenoid of the switching mechanism, and parts near them shown in FIG. 10A. FIG. 11 shows the sorter 1 as dismounted from the printer 2.

With reference to FIG. 9, the selectively switching mechanism 58 includes the selecting flapper 12 as a switching device, the solenoid 61, a first tension spring 62 as an urging device and a link 63 as a transmitting device for transmitting urging force. The solenoid 61 can move the flapper 12 between the first and second guide positions. The spring 62 can urge the flapper 12 toward the second guide position. When the sorter 1 is mounted on the printer 2, the link 63 causes no urging force of the spring 62 to act on the flapper 12. When the sorter 1 is not mounted on the printer 2, the link 63 causes the urging force of the spring 62 to act on the flapper 12.

The selecting flapper 12 includes a horizontal shaft (not shown), a number of flap members 64 and a flapper swinger 66 which are formed integrally. This shaft has an axis 65, extends through the trunk 53 of the adapter casing 27 longitudinally of it, and is supported rotatably between the side portions 51 and 52 of this casing. The flap members 64 are formed on this shaft at intervals along it, protrude downward from the casing trunk 53, and can pivot or swing between the first and second guide positions. The swinger 66 is formed on the right end of this shaft and positioned in the right side portion 51 of the casing 27.

The flapper swinger 66 includes a rear connector 68, a front engaging portion 69 and a middle connector 70. The rear connector 68 and the front engaging portion 69 are positioned opposite each other with respect to the shaft axis 65. The middle connector 70 is positioned above and in front of the axis 65, and between the rear connector 68 and the engaging portion 69. The rear connector 68 is connected to one end of a second tension spring 67, the other end of which is anchored above the swinger 66. This spring 67 urges the selecting flapper 12 toward the first guide position, but is weaker than the first tension spring 62.

The solenoid 61 is positioned in the right side portion 51 of the adapter casing 27, and above and in the rear of the selecting flapper 12. The middle connector 70 of the flapper swinger 66 is connected to a plunger 71. If the solenoid 61 is energized or excited, it retracts the plunger 71.

When the sorter 1 is mounted on the printer 2, the link 63 is out of engagement with the front engaging portion 69 of the flapper swinger 66, as described below. In this situation, if the solenoid 61 is not energized, the second tension spring 67 pulls the rear connector 68 of the swinger 66 upward. This turns the selecting flapper 12 around the axis 65 clockwise in FIG. 9, moving this flapper to the first guide position, which is shown in FIG. 9. If the solenoid 61 is energized, the plunger 71 retracts, pulling the middle connector 70 of the swinger 66 backward. This turns the flapper 12 around the axis 65 counterclockwise in FIG. 9 against the force of the spring 67, moving the flapper to the second guide position, which is shown in FIGS. 10A and 10B.

The link 63 is positioned in front of the selecting flapper 12, and includes a body 73, a first protrusion 74 as a connector, a second protrusion 75 as a second engaging portion, and an engaging portion 76 as a first engaging portion. The link body 73 has a horizontal shaft 72. The protrusions 74 and 75 protrude from one side of the body 73, and are spaced angularly from each other. The engaging portion 76 protrudes from the side of the body 73 opposite the protrusions 74 and 75 with respect to the shaft 72. The body 73 and the parts 72, 74, 75 and 76 are formed integrally. When the sorter 1 is mounted on the printer 2, as shown in FIGS. 9 and 10, the first protrusion 74 is oriented upward and backward, and the second protrusion 75 is oriented downward and backward, while the engaging portion 76 is oriented downward.

The shaft 72 of the link 63 is supported rotatably in the right side portion 51 of the adapter casing. The first protrusion 74 is connected to one end of the first tension spring 62, the other end of which is anchored above and in front of the link 63. This spring 62 urges the link 63 to turn around its shaft 72 clockwise in FIG. 11 so that the second protrusion 75 of the link 63 can engage with the front engaging portion 69 of the flapper swinger 66.

When the sorter 1 is not mounted on the printer 2, as shown in FIG. 11, the first tension spring 62 pulls the first protrusion 74 of the link 63 forward. This turns the link 63 around the shaft 72 clockwise in FIG. 11 to a second engaging position, where the second protrusion 75 of the link 63 pushes the front engaging portion 69 of the flapper swinger 66. The pushing turns the selecting flapper 12 around the shaft axis 65 against the force of the second spring 67 counterclockwise in FIG. 11 to the second guide position, where the flap members 64 are oriented substantially downward.

When the sorter 1 is mounted on the printer 2, as shown in FIGS. 9 and 10, the engaging portion 76 of the link 63 rests on the upper frame 77 of the printer. This turns the link 63 around the shaft 72 against the force of the first tension spring 62 counterclockwise in FIGS. 9 and 10 to a first engaging position, where the second protrusion 75 of the link 63 disengages from the front engaging portion 69 of the flapper swinger 66. The disengagement allows the second tension spring 67 to urge the selecting flapper 12 toward the first guide position, which is shown in FIG. 9, where the flap members 64 are oriented slightly outward or backward. Only if the solenoid 61 is energized, the flapper 12 is turned against the force of the second spring 67 to the second guide position, which is shown in FIGS. 10A and 10B, where the flap members 64 are oriented downward.

When the sorter 1 is in the process of being mounted on the printer 2, and when the sorter is dismounted from the printer, the sorter is not mounted on the printer, as shown in FIG. 11. In this situation, the second protrusion 75 of the link 63 is in engagement with the front engaging portion 69 of the flapper swinger 66. This allows the urging force of the first tension spring 62 to act through the link 63 on the selecting flapper 12. This force keeps the flapper 12 in the second guide position, where the flap members 64 are oriented substantially downward. It is therefore possible to mount the sorter 1 on the printer 2 smoothly without the printer interfering with the flap members 64. This avoids the sorter damage which would be caused if the printer 2 interfered with the flap members 64. Even when the sorter 1 is dismounted from the printer 2, no external force is liable to damage the flap members 64, which are kept in a substantially downward oriented position. It is therefore possible to improve the durability of the sorter 1.

When the sorter 1 is mounted on the printer 2, as shown in FIGS. 9 and 10, the second protrusion 75 of the link 63 is out of engagement with the front engaging portion 69 of the flapper swinger 66. This prevents the urging force of the first tension spring 62 from acting through the link 63 on the selecting flapper 12. Therefore, the actuation of the solenoid 61 can switch the flapper 12 selectively between the first and second guide positions.

When the sorter 1 is not mounted on the printer 2, that is to say, when the sorter is in the process of being mounted on the printer, and when the sorter is dismounted from the printer, the first tension spring 62 keeps the selecting flapper 12 in the second guide position, resulting in no electric power consumption. When the sorter 1 is mounted on the printer 2, the solenoid 61 is energized only if the flapper 12 needs to be in the second guide position for guiding a sheet of paper to the introducing passage 21 of the sorter. Electric power is consumed only for the energization of the solenoid 61. Thus, no electric power for switching the flapper 12 is consumed, not only when the sorter 1 is dismounted, but also if the sorter is not used even when it is mounted on the printer 2. This saves electric power.

When the sorter 1 is mounted on the printer 2, and when the sorter is dismounted from the printer, the link 63 is turned between the engaging positions. This, securely with simple structure, either allows the urging force of the first tension spring 62 to act on the selecting flapper 12 or prevents this force from acting on the flapper. It is therefore possible to simplify the sorter structure and reduce production costs. The sorting unit 28 of the sorter 1 can be fitted to the adapter 29 of the sorter as follows.

With reference to FIGS. 7–12, the support plate 57 in each side portion 51 or 52 of the adapter casing 27 includes a third fitting portion 86 and a fourth fitting portion 87 which are formed integrally. These portions 86 and 87 protrude upward from the top of the casing 27 so as to be fitted into the sorting unit 28.

Figure 12:
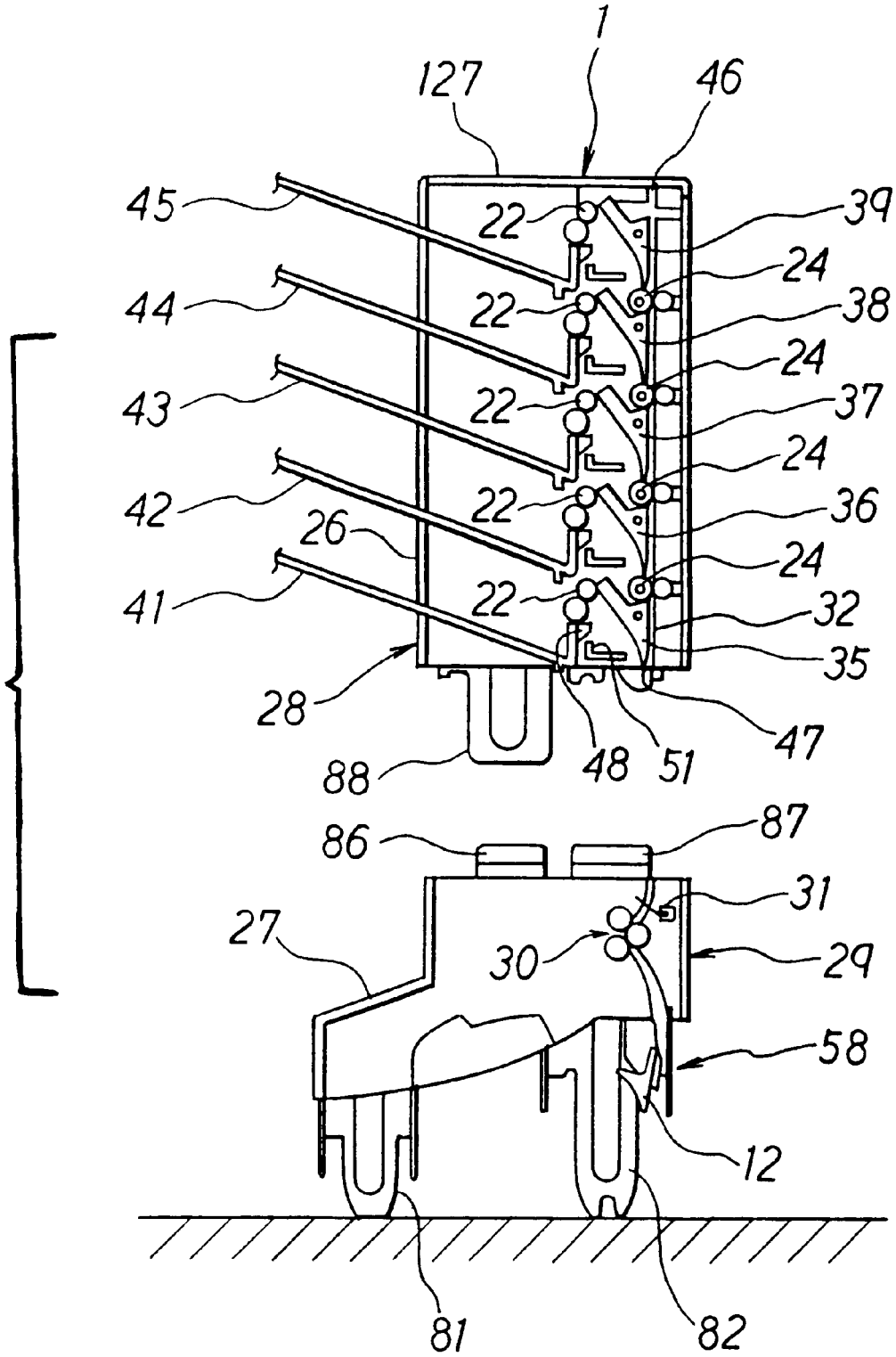
FIG. 12 is a schematic side view in cross section of the sorter, showing how the sorting unit of the sorter is mounted on the adapter.

With reference to FIGS. 3 and 12, each side portion 48 or 49 of the casing 26 of the sorting unit 28 includes a fitting plate 88 protruding downward from its bottom so as to be fitted into the adapter 29.

By inserting the third fitting portion 86 and the fourth fitting portion 87 of the support plate 57 into the sorting unit 28, and inserting the fitting plate 88 of the sorting unit into the adapter 29, as shown in FIG. 6, it is possible to mount this unit in positioned condition on the adapter.

During such fitting, whether the sorting unit 28 is mounted on the adapter 29 or not, as shown in FIGS. 6 and 12, the adapter is placed stably in an upright position without falling down. It is therefore possible to produce the sorter 1 by placing the adapter 29 on a floor and then fitting the sorting unit 28 to the adapter. This makes it possible to fit the sorting unit 28 well to the adapter 29 during the production, and to thereby improve the productivity.

Figure 14:
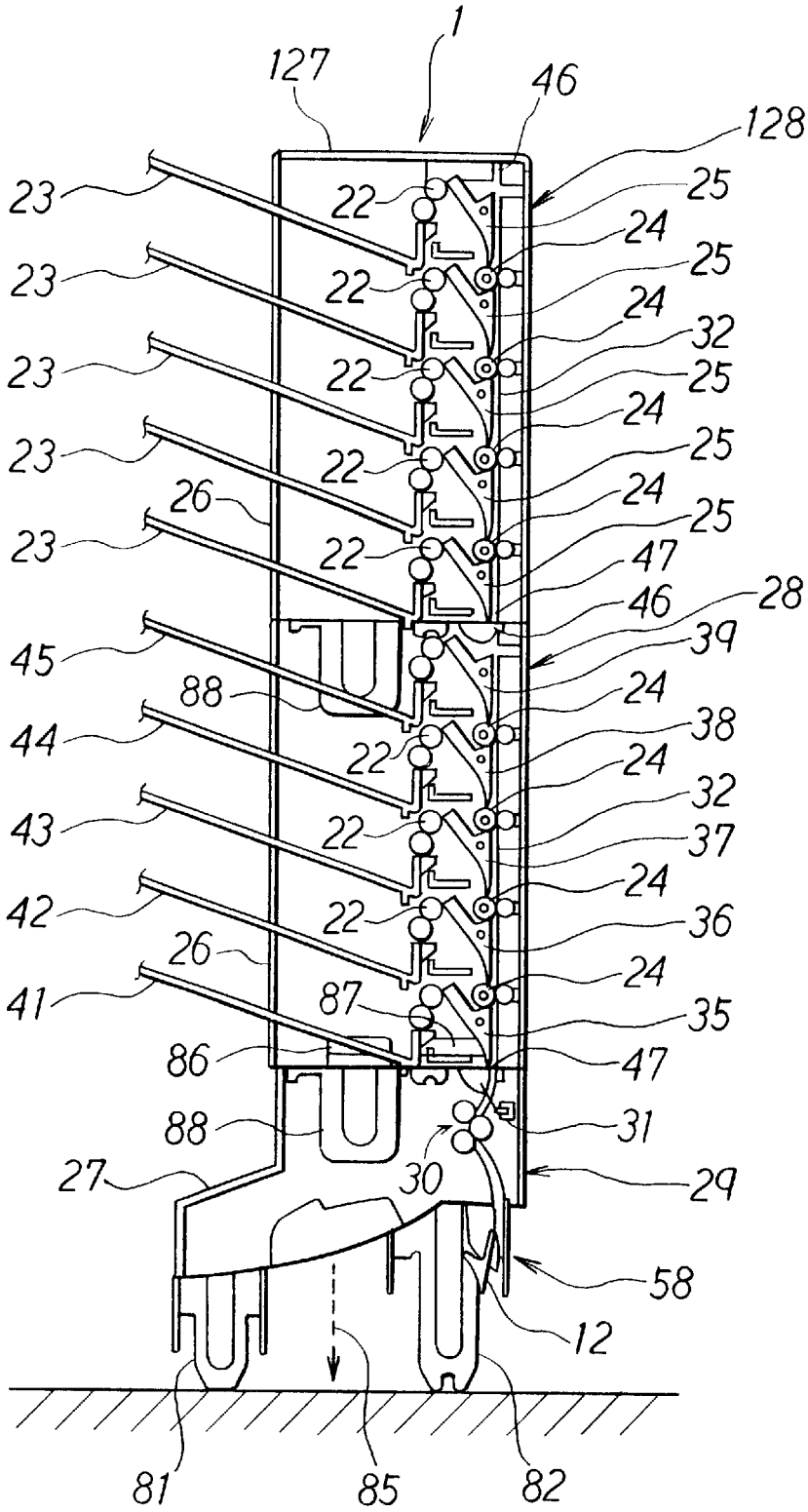
FIG. 14 is a schematic side view in cross section of the sorter, showing the two sorting units as mounted.

As shown in FIGS. 13 and 14, one or more additional sorting units may be mounted on the sorting unit 28. An additional sorting unit 128 is identical with the sorting unit 28, and these units can be mounted on each other. The additional unit 128 includes five switching flappers 25 corresponding to the respective flappers 35–39 of the unit 28 and five bins 23 corresponding to the respective bins 41–45 likewise. Each of the units 28 and 128 includes a removable top lid or cover 127. In FIGS. 13 and 14, the lid (not shown) of the unit 28 is removed, and the additional unit 128 is mounted on the unit 28.

By inserting the fitting plates 88 of the additional sorting unit 128 into the top of the sorting unit 28, as shown in FIG. 14, it is possible to mount the additional unit 128 on the unit 28 in stacked condition. The outlet 46 of the unit 28 is connected to the inlet 47 of the additional unit 128 mounted on the unit 28. The top of the upper sorting unit 128 is covered with its lid 127.

If all the switching flappers 35–39 of the sorting unit 28 mounted on the adapter 29 are in the fourth guide position, a sheet of paper can pass through this unit into the sorting unit 128 mounted on the unit 28. It is therefore possible to sort and store sheets of paper with the units 28 and 128 combined together.

In particular, if only one of the sorting units 28 and 128 were used always, its top flapper 39 would not need to be pivotable, but might be fixed to the third guide position. Because the top flapper 39 of each unit 28 or 128 can pivot between the first and second guide positions like the other switching flappers 35–38 can, the unit can discharge a sheet of paper from its outlet 46. This makes it possible to combine two or more sorting units.

It is therefore possible to add one or more sorting units depending on the number of bins needed by the users. This makes it possible to easily provide, without specially designing, a sorter 1 having an optimum number of bins for the users. Because the sorting units are stacked upward, the mounting area for the sorter 1 does not change even if a number of sorting units are stacked. This makes it possible to provide in a small mounting space a sorter 1 having a number of bins.

Even if one or more sorting units are added, the center of gravity 85 of the sorter 1 does not change substantially, as shown in FIGS. 6 and 14. Even in this case, the center of gravity 85 is positioned substantially at the midpoint between the vertical plane extending through the front fitting portions 81 and the vertical plane extending through the rear fitting portions 82. Likewise, the center 85 is positioned substantially at the midpoint between the two vertical planes each extending through the fitting portions 81 and 82 on one side. This makes it possible to place the sorter 1 on a floor stably, without falling down, in substantially the same upright position in which the sorter is mounted on the printer 2.

It is therefore possible to mount or dismount the additional sorting unit 128 with the adapter 29 placed on a floor. This makes it easier to mount or dismount the unit 128. More specifically, if the additional unit 128 needed mounting or dismounting with the sorter 1 mounted on the printer 2, it would be difficult to mount or dismount this unit at the high position over the sorter on the printer. By contrast, it is easier to mount or dismount the unit 128 with the sorter 1 placed on a floor. This greatly improves the working efficiency.

As shown in FIG. 3, the front legs 54 of the side portions 51 and 52 of the adapter casing 27 protrude forward or are positioned in front of the side portions 48 and 49 of the casing 26 of the sorting unit 28. The front fitting portions 81 of the support plates 57 are positioned in the respective front legs 54. Therefore, even if one pushes the back of the sorting unit 28 mounted on the adapter 29, these fitting portions 81 securely support this unit so that the unit 28 may not fall down. This makes it possible to place the adapter 29 stably even with the unit 28 mounted on the adapter.

With reference to FIG. 14, each of the sorting units 28 and 128 is provided with a motor for driving it. Otherwise, only one of the units 28 and 128 might be provided with a motor for driving them. In such a case, the drive systems in the units 28 and 128 might be coupled together by one or more gears. Instead of the sorting unit 28, the adapter 29 might be provided with a motor.

The recording medium processor (discharging apparatus) according to the invention is not limited to the sorter 1, the processing unit of which is the sorting unit 28. The recording medium processor may instead be a stapler, a puncher, a cutter, a laminator or any other processor. In such a case, the processing unit of the processor is a stapling unit, a punching unit, a cutting unit, a laminating unit or any other unit.

What is claimed is:

1. An image forming machine comprising:

an image forming apparatus for forming images on recording media;

a recording medium discharging apparatus which can be mounted on top of the image forming apparatus, the discharging apparatus including a plurality of recording medium storers; and a locking mechanism for locking the discharging apparatus to the image forming apparatus when the discharging apparatus is mounted on the image forming apparatus;

the locking mechanism including a release lever for unlocking the discharging apparatus by being manipulated to shift in the same direction that the discharging apparatus moves, away from the image forming apparatus to be dismounted from the image forming apparatus.

2. The image forming machine defined in claim 1, wherein the recording medium discharging apparatus includes a holding portion which is held by a user's hand, the release lever is provided on the holding portion.

3. The image forming machine defined in claim 2, wherein the release lever is urged to protrude from the holding portion.

4. The image forming machine defined in claim 3, wherein, when a user lifts the recording medium discharging apparatus from the image forming apparatus, the user's hand draws the release lever until the lever retracts into the holding portion.

5. The image forming machine defined in claim 2, wherein the recording medium discharging apparatus includes a pair of connectors provided on both sides thereof and extending toward the image forming apparatus, the image forming apparatus including a pair of engaging portions for receiving the respective connectors.

6. The image forming machine defined in claim 5, wherein the holding portion is formed substantially at the midpoint between the connectors.

7. The image forming machine defined in claim 2, wherein a vertical plane extends through the center of gravity of the recording medium discharging apparatus laterally across the discharging apparatus, the holding portion being positioned at the plane.

8. The image forming machine defined in claim 1, wherein the locking mechanism further comprises:

a locking member provided at one of the image forming apparatus and the recording medium discharging apparatus, and shiftable between a locking position and an unlocking position; and an engaging portion provided at the other of the image forming apparatus and the discharging apparatus for engaging with the locking member in the locking position.

9. The image forming machine defined in claim 8, wherein the release lever moves to shift the locking member from the locking position to the unlocking position.

10. The image forming machine defined in claim 1, wherein the recording medium discharging apparatus is a mail box.

11. A recording medium discharging apparatus which can be mounted on top of an image forming apparatus for forming images on recording media, the discharging apparatus comprising:

a plurality of recording medium storers; and a locking mechanism for locking the discharging apparatus to the image forming apparatus when the discharging apparatus is mounted on the image forming apparatus;

the locking mechanism including a release lever for unlocking the discharging apparatus by being manipulated to shift in the same direction as the discharging apparatus moves away from the image forming apparatus to be dismounted from the image forming apparatus.

12. The recording medium discharging apparatus defined in claim 11, further comprising a holding portion which is held by a user's hands, the holding portion supporting the release lever.

13. The recording medium discharging apparatus defined in claim 11, further comprising a holding portion which can be held by a user's hands, the release lever being urged to protrude from the holding portion.

14. The recording medium discharging apparatus defined in claim 11, further comprising:

a recording medium introducing section for introducing the recording media with images formed thereon by the image forming apparatus;

a conveying device for conveying the media introduced into the introducing section;

a plurality of discharging devices for discharging to the respective recording medium storers the media conveyed from the conveying device; and a switching device for guiding selectively to one of the discharging devices the media conveyed by the conveying device.

15. The recording medium discharging apparatus defined in claim 13, wherein, when a user lifts the discharging apparatus from the image forming apparatus, the user's hand draws the release lever until the lever retracts into the holding portion.

16. The recording medium discharging apparatus defined in claim 11, wherein the image forming apparatus further includes an engaging portion, the locking mechanism further including a locking member shiftable between a locking position and an unlocking position, the locking member engaging with the engaging portion, the release lever moving to shift the locking member from the locking position to the unlocking position.

17. The recording medium discharging apparatus defined in claim 11, further comprising:

a holding portion which is held by a user's hand; and a pair of connectors provided on both sides of the discharging apparatus and extending toward the image forming apparatus;

the image forming apparatus further including a pair of engaging portions;

the connectors being received by the respective engaging portions when the discharging apparatus is in the process of being connected to the image forming apparatus;

the holding portion being formed substantially at the midpoint between the connectors.

18. A recording medium discharging apparatus which can be mounted on top of an image forming apparatus, the discharging apparatus comprising:

a body including a recording medium storer; and at least three extensions extending downward from the body for mounting the body therewith on the image forming apparatus;

the bottoms of the extensions self supporting the discharging apparatus on a horizontal plane when the discharging apparatus is dismounted from the image forming apparatus.

19. The recording medium discharging apparatus defined in claim 18, wherein the extensions are two pairs of extensions, each pair of extensions extending downward from the discharging apparatus body on one side of the discharging apparatus.

20. The recording medium discharging apparatus defined in claim 19, wherein the image forming apparatus includes four engaging portions for receiving the respective extensions.

21. The recording medium discharging apparatus defined in claim 19, further comprising a pair of connectors for mounting the recording medium storer therewith on the recording medium receiver, the connectors being fitted to either of the storer and the receiver, each of the connectors being positioned between the extensions of one pair.

22. The recording medium discharging apparatus defined in claim 18, wherein the discharging apparatus body includes a recording medium receiver which can be mounted on the image forming apparatus for receiving recording media from the image forming apparatus, the recording medium storer being mounted on the receiver.

23. The recording medium discharging apparatus defined in claim 22, wherein an additional recording medium storer can be mounted on the recording medium storer.

24. The recording medium discharging apparatus defined in claim 22, wherein the recording medium storer includes a plurality of bins, the discharging apparatus further comprising:

a conveying device for conveying the recording media received by the recording medium receiver;

a plurality of discharging devices for discharging to the respective bins the media conveyed from the conveying device; and a switching device for guiding selectively to one of the discharging devices the media conveyed by the conveying device.

25. An image forming apparatus provided with the recording medium discharging apparatus according to claim 18.

26. A recording medium discharging apparatus which can be mounted on top of an image forming apparatus for forming images on recording media, the image forming apparatus including a discharging portion for discharging the media with images formed thereon, the discharging apparatus comprising:

a plurality of recording medium storers;

a recording medium introducing section for introducing the media from the image forming apparatus into the discharging apparatus when the discharging apparatus is mounted on the image forming apparatus;

a switching device for guiding selectively to either of the discharging portion of the image forming apparatus and the introducing section the media with images formed thereon;

a flapper pivotable between a first guide position where the flapper guides recording media to the discharging portion of the image forming apparatus and a second guide position where the flapper guides recording media to the recording medium introducing section;

a driver for driving the flapper; and a urging device for applying urging force to urge the flapper toward the second guide position.

27. The recording medium discharging apparatus defined in claim 26, further comprising a transmitting device for causing no urging force of the urging device to act on the flapper when the discharging apparatus is mounted on the image forming apparatus, and for causing the urging force to act on the flapper when the discharging apparatus is dismounted from the image forming apparatus.

28. The recording medium discharging apparatus defined in claim 27, wherein the image forming apparatus includes an engaging portion, the transmitting device including:

a connector connected to the urging device;

a first engaging portion for engaging with the engaging portion of the image forming apparatus; and a second engaging portion for engaging with the flapper;

the transmitting device being shiftable between a first engaging position where the first engaging portion engages with the image forming apparatus engaging portion so that the second engaging portion disengages from the flapper and a second engaging position where the first engaging portion disengages from the image forming apparatus engaging portion so that the urging force of the urging device engages the second engaging portion with the flapper.

29. The recording medium discharging apparatus defined in claim 27, further comprising:

a conveying device for conveying the recording media introduced into the recording medium introducing section;

a plurality of discharging devices for discharging to the respective recording medium storers the media conveyed from the conveying device; and a switching device for guiding selectively to one of the discharging devices the media conveyed by the conveying device.

30. An image forming apparatus provided with the recording medium discharging apparatus according to claim 26.

* * * * *